US007635549B2

(12) United States Patent
Nakamura et al.

(10) Patent No.: US 7,635,549 B2
(45) Date of Patent: Dec. 22, 2009

(54) TONER AND DEVELOPER, TONER CONTAINER, PROCESS CARTRIDGE, IMAGE FORMING METHOD AND IMAGE FORMING APPARATUS

(75) Inventors: Minoru Nakamura, Takarazuka (JP); Chiyoshi Nozaki, Otsu (JP); Yoshihiro Mikuriya, Nishinomiya (JP); Tsuyoshi Nozaki, Ikeda (JP); Atsushi Yamamoto, Kwawanishi (JP); Masayasu Hagi, Minoh (JP); Takuya Kadota, Kobe (JP); Hiroaki Katoh, Nagaokakyo (JP); Masahide Inoue, Katsuragi (JP)

(73) Assignee: Ricoh Company, Ltd., Tokyo (JP)

( * ) Notice: Subject to any disclaimer, the term of this patent is extended or adjusted under 35 U.S.C. 154(b) by 188 days.

(21) Appl. No.: 11/378,403

(22) Filed: Mar. 20, 2006

(65) Prior Publication Data

US 2006/0210902 A1 Sep. 21, 2006

(30) Foreign Application Priority Data

Mar. 18, 2005 (JP) ..... 2005-078515
Feb. 10, 2006 (JP) ..... 2006-034303

(51) Int. Cl.
*G03G 9/08* (2006.01)

(52) U.S. Cl. ..... 430/108.8; 430/109.1; 430/110.1

(58) Field of Classification Search ..... 430/110.1, 430/109.4, 108.8; 52/199, 222
See application file for complete search history.

(56) References Cited

U.S. PATENT DOCUMENTS 6,063,537 A * 5/2000 Nakamura et al. ..... 430/110.3
2004/0137351 A1* 7/2004 Sato ..... 430/108.8
2005/0042534 A1* 2/2005 Tanaka et al. ..... 430/108.4

FOREIGN PATENT DOCUMENTS

JP 07-013386 1/1995
JP 08-050367 2/1996

OTHER PUBLICATIONS

U.S. Appl. No. 11/685,313, filed Mar. 13, 2007, Nozaki, et al.

(Continued)

*Primary Examiner*—Mark F Huff
*Assistant Examiner*—Peter L Vajda
(74) *Attorney, Agent, or Firm*—Oblon, Spivak, McClelland, Maier & Neustadt, L.L.P.

(57) ABSTRACT

A toner including a binder resin, a colorant and a release agent, and satisfying the following relationships (1) and (2):

$$1.0 \leqq FT120/FT160 \leqq 1.5 \quad (1)$$

wherein FT120 is a maximum tensile strength (N) when a recording medium having the toner unfixed on is vertically separated from the surface of a substrate having a temperature of 120° C. at a constant speed after pressed thereto at a pressure of 100 kPa, and FT160 is same except that the substrate has a temperature of 160° C.;

$$1.0 \leqq FP100/FP200 \leqq 1.5 \quad (2)$$

wherein FP100 is a maximum tensile strength (N) when a recording medium having the toner unfixed on is vertically separated from the surface of a substrate having a temperature of 160° C. at a constant speed after pressed thereto at a pressure of 100 kPa, and FP200 is same except that the pressure is 200 kPa.

25 Claims, 6 Drawing Sheets

OTHER PUBLICATIONS

U.S. Appl. No. 11/685,890, filed Mar. 14, 2007, Nozaki, et al.
U.S. Appl. No. 11/687,431, filed Mar. 16, 2007, Matsumoto, et al.
U.S. Appl. No. 11/684,131, filed Mar. 9, 2007, Yasunaga, et al.
U.S. Appl. No. 11/686,801, filed Mar. 15, 2007, Kato, et al.
U.S. Appl. No. 11/681,530, filed Mar. 2, 2007, Kadota, et al.
U.S. Appl. No. 11/687,352, filed Mar. 16, 2007, Kurose, et al.
U.S. Appl. No. 11/924,994, filed Oct. 26, 2007, Katoh, et al.
U.S. Appl. No. 11/963,279, filed Dec. 21, 2007, Mikuriya, et al.
U.S. Appl. No. 12/010,369, filed Jan. 24, 2008, Yasunaga, et al.
U.S. Appl. No. 12/027,704, filed Feb. 7, 2008, Fuwa, et al.
U.S. Appl. No. 11/965,522, filed Dec. 27, 2007, Fuwa, et al.
U.S. Appl. No. 12/017,853, filed Jan. 22, 2008, Masumoto, et al.
U.S. Appl. No. 12/026,057, filed Feb. 5, 2008, Nozaki, et al.
U.S. Appl. No. 12/035,892, filed Feb. 22, 2008, Kadota, et al.
U.S. Appl. No. 12/046,784, filed Mar. 12, 2008, Nozaki, et al.
U.S. Appl. No. 12/046,866, filed Mar. 12, 2008, Masumoto, et al.
U.S. Appl. No. 12/048,689, filed Mar. 14, 2008, Kadota, et al.
U.S. Appl. No. 12/049,719, filed Mar. 17, 2008, Yamamoto, et al.
U.S. Appl. No. 12/050,663, filed Mar. 18, 2008, Izutani, et al.
U.S. Appl. No. 12/050,963, filed Mar. 19, 2008, Ishikawa, et al.
U.S. Appl. No. 12/051,248, filed Mar. 19, 2008, Hagi, et al.
U.S. Appl. No. 11/616,198, filed Dec. 26, 2006, Takuya Kadota, et al.
U.S. Appl. No. 11/696,879, filed Apr. 5, 2007, Yasunaga, et al.
U.S. Appl. No. 11/772,404, filed Jul. 2, 2007, Nakamura, et al.
U.S. Appl. No. 11/779,648, filed Jul. 18, 2007, Yamamoto, et al.
U.S. Appl. No. 11/851,048, filed Sep. 6, 2007, Murakami, et al.
U.S. Appl. No. 11/851,617, filed Sep. 7, 2007, Murakami, et al.
U.S. Appl. No. 11/854,783, filed Sep. 13, 2007, Nakamura, et al.
U.S. Appl. No. 11/855,759, filed Sep. 14, 2007, Katoh, et al.
U.S. Appl. No. 11/856,248, filed Sep. 17, 2007, Murakami, et al.
U.S. Appl. No. 11/855,739, filed Sep. 14, 2007, Fuwa, et al.
U.S. Appl. No. 12/048,865, filed Mar. 14, 2008, Yasunaga, et al.
U.S. Appl. No. 12/043,633, filed Mar. 6, 2008, Nakamura, et al.
U.S. Appl. No. 12/046,869, filed Mar. 12, 2008, Nozaki, et al.

* cited by examiner

TONER AND DEVELOPER, TONER CONTAINER, PROCESS CARTRIDGE, IMAGE FORMING METHOD AND IMAGE FORMING APPARATUS

BACKGROUND OF THE INVENTION

1. Field of the Invention

The present invention relates to a toner for developing electrostatic latent images in full-color image forming apparatus, electrostatic recording and electrostatic printing, such as full-color electrostatic copiers and full-color laser beam printers, and to a developer, a toner container, a process cartridge, an image forming apparatus and image forming method using the toner.

2. Discussion of the Background

Recently, the toner is required to have a small particle diameter and a sharp distribution thereof to produce images having higher quality. In the image forming apparatus forming full-color images with a toner having plural colors, a fixing oil such as a silicone oil is applied or impregnated to the fixer such as a heat roll and a pressure roll to prevent an offset development and smoothly separate a recording paper from the fixer. Further, the full-color image forming apparatus is required to have a smaller size and a lower cost, and to have an oilless fixer without a fixing oil applicator.

However, when a toner image is fixed on a transfer paper by a contact heat fixing method such as an oilless heat roll fixing method and a belt fixing method, the melted toner transfers to the fixing roller and fixing belt. The transferred toner adheres to the following transfer paper again to cause an image noise, i.e., an offset phenomenon. In addition, no oil applicator makes it difficult to separate the recording paper from the fixer. This is worse when a toner having a small particle diameter is used.

In order to solve this problem, methods of adding a release agent to a toner is disclosed. For example, Japanese Patent No. 3270198 discloses a toner comprising a binder resin, a release agent, a colorant and an external additive has an adherence not greater than 0.015 dyne at a contact point by perpendicular tensile fracture after application of a load of 1 $kg/cm^2$ thereto. The release agent is a carnauba wax, which tends to be a fibrous island in a sea and island structure inside the toner when used alone, and difficult to exude on the surface thereof.

Japanese Laid-Open Patent Publication No. 8-050367 discloses a toner comprising a binder resin, a colorant and a wax composition, wherein the wax composition comprises an ester wax having a maximum value in a range of from 350 to 850 and from 900 to 4,000 in a GPC molecular weight distribution. However, the ester wax tends to be a spherical or a spindle-shaped island in a sea and island structure inside the toner when used, and largely dependent on a heat and easy to exude on the surface thereof when heated.

On the other hand, in order to downsize the full-color image forming apparatus, the image developer needs to be downsized. This is because the full-color image forming apparatus needs four image developers containing a cyan developer, a yellow developer, a magenta developer and a black developer respectively. In order to downsize the image developer, non-magnetic one-component developer has an advantage because a stirrer stirring a toner and a carrier is not necessary. However, the non-magnetic one-component developer tends to adhere to developer bearers or regulators. A toner including a instantly melting binder resin for producing fill-color images tends to have this problem, and particularly a toner including a release agent does.

Because of these reasons, a need exists for a toner having good offset resistance and separability, not filming over photoreceptors, and scarcely adhering to the developer bearers or regulators even when used as a non-magnetic one-component developer.

SUMMARY OF THE INVENTION

Accordingly, an object of the present invention is to provide a toner having good offset resistance and separability, not filming over photoreceptors, and scarcely adhering to the developer bearers or regulators even when used as a non-magnetic one-component developer.

Another object of the present invention is to provide a developer including the toner.

A further object of the present invention is to provide a container containing the toner.

Another object of the present invention is to provide a process cartridge using the toner.

A further object of the present invention is to provide an image forming apparatus using the toner.

Another object of the present invention is to provide an image forming method using the toner.

These objects and other objects of the present invention, either individually or collectively, have been satisfied by the discovery of a toner, comprising a binder resin, a colorant and a release agent, wherein the toner satisfies the following relationships (1) and (2):

$$1.0 \leqq FT120/FT160 \leqq 1.5 \quad (1)$$

wherein FT120 is a maximum tensile strength (N) when a recording medium having the toner unfixed on is vertically separated from the surface of a substrate having a temperature of 120° C. at a constant speed after pressed thereto at a pressure of 100 kPa, and FT160 is a maximum tensile strength (N) when a recording medium having the toner unfixed on is vertically separated from the surface of a substrate having a temperature of 160° C. at a constant speed after pressed thereto at a pressure of 100 kPa;

$$1.0 \leqq FP100/FP200 \leqq 1.5 \quad (2)$$

wherein FP100 is a maximum tensile strength (N) when a recording medium having the toner unfixed on is vertically separated from the surface of a substrate having a temperature of 160° C. at a constant speed after pressed thereto at a pressure of 100 kPa, and FP 200 is a maximum tensile strength (N) when a recording medium having the toner unfixed on is vertically separated from the surface of a substrate having a temperature of 160° C. at a constant speed after pressed thereto at a pressure of 200 kPa.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1A:
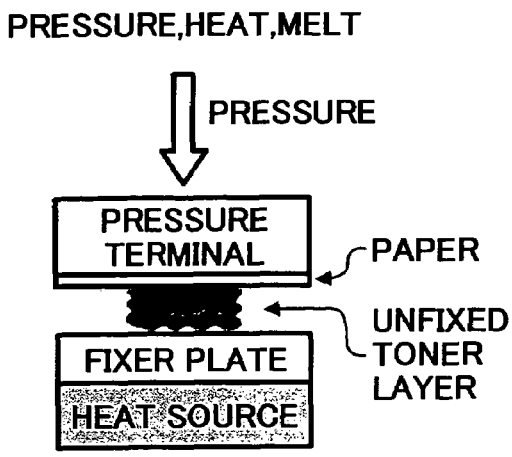
FIG. 1 is a schematic view for explaining the method of measuring the maximum tensile strength (N) of a toner.

The present invention provides a toner having good offset resistance and separability, not filming over photoreceptors, and scarcely adhering to the developer bearers or regulators even when used as a non-magnetic one-component developer.

The toner of the present invention includes at least a binder resin, a colorant and a release agent, and optionally includes other components, and preferably satisfies the following relationship:

$$1.0 \leqq FT120/FT160 \leqq 1.5$$

wherein FT120 is a maximum tensile strength (N) when a recording medium having the toner unfixed on is vertically separated from the surface of a substrate having a temperature of 120° C. at a constant speed after pressed thereto at a pressure of 100 kPa, and FT160 is a maximum tensile strength (N) when a recording medium having the toner unfixed on is vertically separated from the surface of a substrate having a temperature of 160° C. at a constant speed after pressed thereto at a pressure of 100 kPa; and more preferably satisfies the following relationship:

$$1.1 \leqq FT120/FT160 \leqq 1.4.$$

A toner satisfying the above-mentioned relationship has stable separability in a wide fixable temperature range without filming over photoreceptors or adhering to a developer regulator. When less than 1.0, the tensile strength is higher at higher temperatures, and the separability deteriorates at high temperatures and offset problems occur at low temperatures. When greater than 1.5, the tensile strength noticeably deteriorates at higher temperatures, and the toner largely depends on heat and does not have stable separability. This causes toner adherence to the developer regulator or filming over photoreceptors.

In addition to this relationship, the toner preferably satisfies the following relationship:

$$1.0 \leqq FP100/FP200 \leqq 1.5$$

wherein FP100 is a maximum tensile strength (N) when a recording medium having the toner unfixed on is vertically separated from the surface of a substrate having a temperature of 160° C. at a constant speed after pressed thereto at a pressure of 100 kPa, and FP200 is a maximum tensile strength (N) when a recording medium having the toner unfixed on is vertically separated from the surface of a substrate having a temperature of 160° C. at a constant speed after pressed thereto at a pressure of 200 kPa; and more preferably satisfies the following relationship:

$$1.2 \leqq FP100/FP200 \leqq 1.5$$

A toner satisfying the above-mentioned relationship has sufficient separability without much depending on the fixing pressure even from a thin paper.

When less than 1.0, the tensile strength is higher at high pressures, and the separability deteriorates or offset problems occur at high pressures. When greater than 1.5, the tensile strength noticeably deteriorates at higher pressures, and the toner largely depends on pressure and does not have stable separability.

Further, the toner preferably satisfies the following relationship:

$$1.0 \leqq FT120/FT140 \leqq 1.3$$

wherein FT120 is a maximum tensile strength (N) when a recording medium having the toner unfixed on is vertically separated from the surface of a substrate having a temperature of 120° C. at a constant speed after pressed thereto at a pressure of 100 kPa, and FT140 is a maximum tensile strength (N) when a recording medium having the toner unfixed on is vertically separated from the surface of a substrate having a temperature of 140° C. at a constant speed after pressed thereto at a pressure of 100 kPa; and more preferably satisfies the following relationship:

$$1.0 \leqq FT120/FT140 \leqq 1.2$$

In addition to this relationship, the toner preferably satisfies the following relationship:

$$1.0 \leqq FT140/FT160 \leqq 1.3$$

and more preferably satisfies the following relationship:

$$1.0 \leqq FT140/FT160 \leqq 1.2$$

When FT120/FT140 and FT140/FT160 are out of these ranges, the separability deteriorates.

Further, FT120 is preferably not greater than 1.5, and more preferably from 0.1 to 1.4. When greater than 1.5, the separability deteriorates at low temperatures.

The maximum tensile strength can be measured by the following method.

Figure 1B:
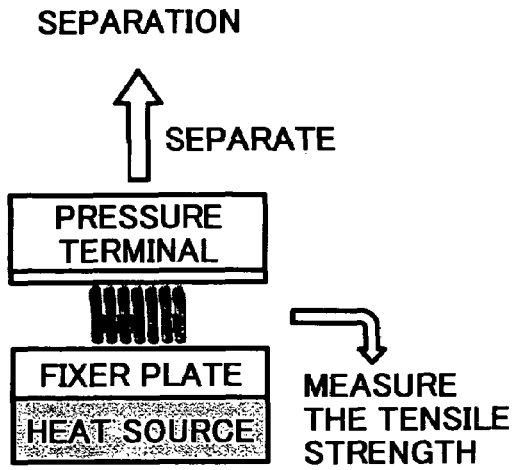

After a recording medium having a toner unfixed on is pressed to the surface of a substrate having a specified temperature using a measurer shown in FIG. 1 wherein the substrate is an aluminum plate coated with TEFLON PFA (perfluoroalkoxy resin from DU PONT-MITSUI FLUOROCHEMICALS COMPANY, LTD.), having a width of 50 mm, a depth 60 mm and a thickness of 2 mm; the pressure terminal speed before pressing is 3 mm/sec; the pressing time is 2 sec; the tensile speed is 300 mm/min; the pressure is 100 kPa or 200 kPa; the image area is 15 mm×15 mm; toner amount is 10 g/m$^2$; and the temperature is from 120 to 160° C., the recording medium having the toner unfixed on is vertically separated therefrom at a constant speed and the tensile strength is continuously measured to find a maximum tensile strength.

Two cartridge heaters are used as the heat source and a temperature sensor is located on the edge of the plate surface and the plate surface temperature is controlled to be within ±2° C. by a temperature controller.

The pressure terminal is a heat-resistant silicone rubber having an area of 25 mm×25 mm and a hardness of 30° at the pressing side.

An unfixed solid image including a toner of 10 g/m$^2$ having an area of 15 mm×15 mm is produced on the center of a paper having a width of 35 mm and a length of 135 mm by a full-color printer LP-3000C from SEIKO EPSON CORPORATION.

The unfixed solid image is pressed to the TEFLON plate, and heated for a specified time. The peel force between the toner and the TEFLON plate is continuously measured to determine the maximum tensile strength.

An ultra-thin slice of the toner of the present invention preferably has a sea and island structure in a cross section thereof when imaged with a transmittance electron microscope (TEM), wherein the island preferably has the shape of a sphere, a spindle or a fiber.

When an ultra-thin slice of a toner has a sea and island structure in a cross section thereof, the toner has good separability in a wide range of temperature. This is because a release agent having the shape of a sphere or a spindle exudes fast at low temperatures between the surface of a receiving material and a fixer, and a release agent having the shape of a fiber exudes slow at high temperatures therebetween.

The cross section of an ultra-thin slice of a toner can be observed with a TEM by burying the toner in an epoxy resin; making a slice of the toner buried therein, having a thickness of about 100 nm; and dying the slice with ruthenium tetroxide.

Materials and methods of preparing the toner of the present invention are not particularly limited, and the toner can be prepared by known methods such as pulverization and classification methods; suspension polymerization methods, emulsification polymerization methods and polymer suspension methods, etc., which are emulsifying, suspending or agglutinating an oil phase in an aqueous medium to form a parent toner.

The pulverization method includes melting, kneading, pulverizing and classifying toner constituents to form a parent toner. A mechanical force may be applied to the parent toner to have an average circularity of from 0.97 to 1.0. A HYBRIDIZER or a MECHANOFUSION can apply the mechanical force thereto.

The suspension polymerization methods include dispersing a colorant, a release agent, etc. in an oil-soluble polymerization initiator and a polymerizing monomer to prepare a dispersion; and emulsifying the dispersion in an aqueous medium including a surfactant, a solid dispersant, etc. by an emulsification method mentioned later. After polymerized, a wet treatment applying an inorganic particulate material to the resultant parent toner is performed. Before the wet treatment, the excessive surfactant is preferably washed from the parent toner.

Specific examples of the polymerizing monomer include acids such as an acrylic acid, a methacrylic acid, an α-cyanoacrylic acid, an α-cyanomethacrylic acid, an itaconic acid, a crotonic acid, a fumaric acid and a maleic acid or a maleic acid anhydride; acrylates or methacrylates having an amino group such as acrylamide, methacrylamide, diacetoneacrylamide or their methylol compounds, vinylpyridine, vinylpyrrolidone, vinylimidazole, ethyleneimine and dimethylaminoethyl methacrylate. These can induce a functional group to the surface of the parent toner.

An acid radical or basic group as a dispersant is absorbed to the surface of the parent toner to induce a functional group thereto.

The emulsification polymerization methods include emulsifying a water-soluble polymerization initiator and a polymerizing monomer in water with a surfactant to prepare a latex by conventional emulsification polymerization methods. A dispersion wherein a colorant and a release agent are dispersed is separately prepared, and the dispersion is mixed with the latex. The mixture is agglutinated to have a toner size and fusion-bonded to prepare a parent toner. Then, a wet treatment. applying an inorganic particulate material to the resultant parent toner is performed. Specific examples of the polymerizing monomer include the materials mentioned in the suspension polymerization methods.

The toner is preferably granulated by emulsifying or dispersing a solution or a dispersion including toner constituents in an aqueous medium because of high selectivity of resins; high low-temperature fixability and easiness of controlling a particle diameter, a particle diameter distribution and a shape.

The solution including the toner constituents is a solvent wherein the toner constituents are dissolved, and the dispersion including the toner constituents is a solvent wherein the toner constituents are dispersed.

Specific examples of the toner constituents include at least an adhesive base material formed from a reaction among a compound including a group having an active hydrogen, a polymer reactable therewith, a binder resin, a release agent and a colorant; and further, optionally include a particulate resin, a charge controlling agent, etc.

The adhesive base material has adhesiveness to a recording medium such as a paper, includes at least an adhesive polymer formed from a reaction between the compound including a group having an active hydrogen and the polymer reactable therewith un an aqueous medium, and may include a binder resin optionally selected from conventional resins.

The adhesive base material preferably has a weight-average molecular weight not less than 1,000, more preferably from 2,000 to 10,000,000, and much more preferably from 3,000 to 1,000,000.

When less than 1,000, the hot offset resistance of the resultant toner occasionally deteriorates.

The adhesive base material preferably has a temperature (TG') not less than 100° C., and more preferably of from 110 to 200° C. at which a storage modulus thereof is 10,000 dyne/cm$^2$ at a measuring frequency of 20 Hz. When less than 100° C., the hot offset resistance of the resultant toner deteriorates. The toner binder resin preferably has a temperature (Tη) not greater than 180° C., and more preferably of from 90 to 160° C. at which a viscosity is 1,000 poise. When greater than 180° C., the low-temperature fixability of the resultant toner deteriorates.

Therefore, TG' is preferably higher than Tη in terms of the low-temperature fixability and hot offset resistance of the resultant toner. Namely, a difference between TG' and Tη (TG'-Tη) is preferably not less than 0° C., more preferably not less than 10° C., and furthermore preferably not less than 20° C. The larger, the better.

In terms of the thermostable preservability and low-temperature fixability of the resultant toner, the difference between TG' and Tη (TG'-Tη) is preferably from 0 to 100° C., more preferably from 10 to 90° C., and most preferably from 20 to 80° C.

Specific examples of the adhesive base material include polyester resins.

Specific examples of the polyester resins include urea-modified polyester resins.

The urea-modified polyester resins are formed from a reaction between amines (B) as the compound including group having an active hydrogen and a polyester prepolymer including an isocyanate group (A) as the polymer reactable therewith in the aqueous medium.

The urea-modified polyester resins may include a urethane bonding as well as a urea bonding. A molar ratio (urea/urethane) of the urea bonding to the urethane bonding is from 100/0 to 10/90, preferably from 80/20 to 20/80 and more preferably from 60/40 to 30/70. When the urea bonding has a molar ratio less than 10%, hot offset resistance of the resultant toner deteriorates.

Specific examples of the urea-modified polyester resins include (1) a mixture of a urea-modified polyester prepolymer with isophoronediamine, which is formed from a reacting a polycondensate of an adduct of bisphenol A with 2 moles of ethyleneoxide and an isophthalic acid with isophoronediisocyanate; and a polycondensate of an adduct of bisphenol A with 2 moles of ethyleneoxide and an isophthalic acid, (2) a mixture of a urea-modified polyester prepolymer with isophoronediamine, which is formed from a reacting a polycondensate of an adduct of bisphenol A with 2 moles of ethyleneoxide and an isophthalic acid with isophoronediisocyanate; and a polycondensate of an adduct of bisphenol A with 2 moles of ethyleneoxide and a terephthalic acid, (3) a mixture of a urea-modified polyester prepolymer with isophoronediamine, which is formed from a reacting a polycondensate of an adduct of bisphenol A with 2 moles of ethyleneoxide/an adduct of bisphenol A with 2 moles of propyleneoxide and an terephthalic acid with isophoronediisocyanate; and a polycondensate of an adduct of bisphenol A with 2 moles of ethyleneoxide/an adduct of bisphenol A with 2 moles of propyleneoxide and a terephthalic acid, (4) a mixture of a urea-modified polyester prepolymer with isophoronediamine, which is formed from a reacting a polycondensate of an adduct of bisphenol A with 2 moles of ethyleneoxide/an adduct of bisphenol A with 2 moles of propyleneoxide and an terephthalic acid with isophoronediisocyanate; and a polycondensate of an adduct of bisphenol A with 2 moles of propyleneoxide and a terephthalic acid, (5) a mixture of aurea-modified polyester prepolymer with hexamethylenediamine, which is formed from a reacting a polycondensate of an adduct of bisphenol A with 2 moles of ethyleneoxide and an terephthalic acid with isophoronediisocyanate; and a polycondensate of an adduct of bisphenol A with 2 moles of ethyleneoxide and a terephthalic acid, (6) a mixture of a urea-modified polyester prepolymer with hexamethylenediamine, which is formed from a reacting a polycondensate of an adduct of bisphenol A with 2 moles of ethyleneoxide and an terephthalic acid with isophoronediisocyanate; and a polycondensate of an adduct of bisphenol A with 2 moles of ethyleneoxide/an adduct of bisphenol A with 2 moles of propyleneoxide and a terephthalic acid, (7) a mixture of a urea-modified polyester prepolymer with ethylenediamine, which is formed from a reacting a polycondensate of an adduct of bisphenol A with 2 moles of ethyleneoxide and an terephthalic acid with isophoronediisocyanate; and a polycondensate of an adduct of bisphenol A with 2 moles of ethyleneoxide and a terephthalic acid, (8) a mixture of a urea-modified polyester prepolymer with hexamethylenediamine, which is formed from a reacting a polycondensate of an adduct of bisphenol A with 2 moles of ethyleneoxide and an isophthalic acid with diphenylmethanediisocyanate; and a polycondensate of an adduct of bisphenol A with 2 moles of ethyleneoxide and an isophthalic acid, (9) a mixture of a urea-modified polyester prepolymer with hexamethylenediamine, which is formed from a reacting a polycondensate of an adduct of bisphenol A with 2 moles of ethyleneoxide/an adduct of bisphenol A with 2 moles of propyleneoxide and an terephthalic acid/dodecenylsuccinic acid anhydride with diphenylmethanediisocyanate; and a polycondensate of an adduct of bisphenol A with 2 moles of ethyleneoxide/an adduct of bisphenol A with 2 moles of propyleneoxide and a terephthalic acid, and (10) a mixture of a urea-modified polyester prepolymer with hexamethylenediamine, which is formed from a reacting a polycondensate of an adduct of bisphenol A with 2 moles of ethyleneoxide and an isophthalic acid with toluenediisocyanate; and a polycondensate of an adduct of bisphenol A with 2 moles of ethyleneoxide and an isophthalic acid.

The compound including a group having an active hydrogen performs as an elongator or a crosslinker when the polymer reactable therewith is subject to an elongation or crosslinking reaction in the aqueous medium. Specific examples of the compound including a group having an active hydrogen include amines (B) when the polymer reactable therewith is the polyester prepolymer including an isocyanate group because of being polymerizable from an elongation or a crosslinking reaction with the polyester prepolymer including an isocyanate group.

Specific examples of the a group having an active hydrogen include hydroxyl groups such as an alcoholic hydroxyl group and a phenolic hydroxyl group, an amino group, a carboxyl group, a mercapto group, etc. These can be used alone or in combination. Among these, the alcoholic hydroxyl group is preferably used.

Specific examples of the amines (B) include diamines (B1), polyamines (B2) having three or more amino groups, amino alcohols (B3), amino mercaptans (B4), amino acids (B5) and blocked amines (B6) in which the amino groups in the amines (B1) to (B5) are blocked.

These can be used alone or in combination. Among these, the diamine (B1), and a mixture of the diamine (B1) and a small amount of the polyamines (B2) having three or more amino groups are preferably used.

Specific examples of the diamines (B1) include aromatic diamines such as phenylene diamine, diethyltoluene diamine and 4,4'-diaminodiphenyl methane; alicyclic diamines such as 4,4'-diamino-3,3'-dimethyldicyclohexyl methane, diaminocyclohexane and isophoronediamine; aliphatic diamines such as ethylene diamine, tetramethylene diamine and hexamethylene diamine.

Specific examples of the polyamines (B2) having three or more amino groups include diethylene triamine, triethylene tetramine, etc.

Specific examples of the amino alcohols (B3) include ethanol amine, hydroxyethyl aniline, etc.

Specific examples of the amino mercaptan (B4) include aminoethyl mercaptan, aminopropyl mercaptan, etc.

Specific examples of the amino acids (B5) include amino propionic acid, amino caproic acid, etc.

Specific examples of the blocked amines (B6) include ketimine compounds which are prepared by reacting one of the amines (B1) to (B5) with a ketone such as acetone, methyl ethyl ketone and methyl isobutyl ketone; oxazoline compounds, etc.

A reaction terminator can be used to terminate the elongation or crosslinking reaction between the compound including a group having an active hydrogen and the polymer reactable therewith. The reaction terminator is preferably used to control the molecular weight of the adhesive base material. Specific examples of the reaction terminator include monoamines such as diethyle amine, dibutyl amine, butyl amine and lauryl amine, and blocked amines, i.e., ketimine compounds prepared by blocking the monoamines mentioned above.

A mixing ratio, i.e., a ratio [NCO]/[NHx] of the isocyanate group [NCO] in the prepolymer (A) to the amino group [NHx] in the amine (B) is preferably from 1/3 to 3/1, more preferably from 1/2 to 2/1, and even more preferably from 1/1.5 to 1.5/1.

When the mixing ratio ([NCO]/[NHx]) is less than 1/3, the low-temperature fixability of the resultant toner deteriorates. When greater than 3/1, the hot offset resistance thereof deteriorates.

The polymer reactable with the compound having a group including an active hydrogen (hereinafter referred to as a "prepolymer") is not particularly limited, and can be selected in accordance with the purpose, provided that the polymer at least has a site reactable with the compound having a group including an active hydrogen. Specific examples thereof include apolyol resins, apolyacrylic resin, apolyester resin, an epoxy resin, their derivatives, etc.

These can be used alone or in combination. Among these resins, the polyester resin having high fluidity when melting and transparency is preferably used.

The site reactable with the compound having a group including an active hydrogen is not particularly limited, and can be selected in accordance with the purpose. Specific examples thereof include an isocyanate group, an epoxy group, a carboxylic acid group, an acid chloride group, etc.

These can be used alone or in combination. Among these groups, the isocyanate group is preferably used.

Among the prepolymers, a polyester resin including a group formed by urea bonding (RMPE) is preferably used because of being capable of controlling the molecular weight of the polymer components, imparting oilless low-temperature fixability to a dry toner, and good releasability and fixability thereto even in an apparatus without a release oil applicator to a heating medium for fixing.

The group formed by urea bonding includes an isocyanate group, etc. When the group formed by urea bonding of the polyester resin including a group formed by urea bonding (RMPE) is an isocyanate group, the polyester prepolymer including an isocyanate group (A) is preferably used as the polyester resin including a group formed by urea bonding (RMPE).

The polyester prepolymer including an isocyanate group (A) is not particularly limited, and can be selected in accordance with the purpose. For example, the polyester prepolymers including an isocyanate group (A) can be prepared by reacting a polycondensation product of a polyol (PO) and a polycarboxylic acid (PC), i.e., a polyester resin having a group including an active hydrogen atom, with a polyisocyanate (PIC).

The polyol (PO) is not particularly limited, and can be selected in accordance with the purpose. For example, suitable polyols (PO) include diols (DIO), polyols (TO) having three or more hydroxyl groups, and mixtures of DIO and TO. These can be used alone or in combination. Diols (DIO) alone or mixtures of a diol (DIO) with a small amount of polyol (TO) are preferably used.

Specific examples of the diols DIO include alkylene glycols, alkylene ether glycols, alicyclic diols, bisphenols, alkylene oxide adducts of alicyclic diols, alkylene oxide adducts of bisphenols, etc.

Specific examples of the alkylene glycols include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropyleneglycol, polyethyleneglycol, polypropylene glycol and polytetramethylene ether glycol. Specific examples of the alicyclic diols include 1,4-cyclohexanedimethanol and hydrogenated bisphenol A. Specific examples of the bisphenols include bisphenol A, bisphenol F and bisphenol S. Specific examples of the alkylene oxide adducts of alicyclic diols include adducts of the alicyclic diols mentioned above with an alkylene oxide (e.g., ethyleneoxide, propylene oxide and butylene oxide). Specific examples of the alkylene oxide adducts of bisphenols include adducts of the bisphenols mentioned above with an alkylene oxide (e.g., ethylene oxide, propylene oxide and butylene oxide).

Among these compounds, alkylene glycols having from 2 to 12 carbon atoms and adducts of bisphenols with an alkylene oxide are preferably used, and adducts of bisphenols with an alkylene oxide, and mixtures of an adduct of bisphenols with an alkylene oxide and an alkylene glycol having from 2 to 12 carbon atoms are more preferably used.

Specific examples of the TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide such as ethylene oxide, propylene oxide and butylene oxide.

A mixing ratio (DIO/TO) of the DIO to the TO is preferably 100/0.01 to 10, and more preferably 100/0.01 to 1.

Specific examples of the polycarboxylic acids (PC) include dicarboxylic acids (DIC) and polycarboxylic acids having three or more carboxyl groups (TC). These can be used alone or in combination. The dicarboxylic acids (DIC) alone and a mixture of the dicarboxylic acids (DIC) and a small amount of the polycarboxylic acid having three or more carboxyl groups (TC) are preferably used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acid having three or more hydroxyl groups (TC) include aromatic polycarboxylic acids having from 9 to 20 carbon atoms (e.g., trimellitic acid and pyromellitic acid).

Anhydrides or lower alkyl esters (e.g., methyl esters, ethyl esters or isopropyl esters) of the dicarboxylic acids (DIC), the polycarboxylic acids having three or more hydroxyl groups (TC) or their mixture can also be used as the polycarboxylic acid (PC). Specific examples of the lower alkyl esters include a methyl ester, an ethyl ester, an isopropyl ester, etc.

A mixing ratio (DIC/TC) of the DIC to the TC is preferably from 100/0.01 to 10, and more preferably from 100/0.01 to 1.

Suitable mixing ratio (i.e., the equivalence ratio [OH]/[COOH]) of the [OH] group of a polyol (PO) to the [COOH] group of a polycarboxylic acid (PC) is from 2/1 to 1/1, preferably from 1.5/1 to 1/1 and more preferably from 1.3/1 to 1.02/1.

The polyester prepolymer including an isocyanate group (A) preferably includes the polyol (PO) in an amount of from 0.5 to 40% by weight, more preferably from 1 to 30% by weight, and even more preferably from 2 to 20% by weight.

When less than 0.5% by weight, the hot offset resistance of the resultant toner deteriorates, which is difficult to have both thermostable preservability and low-temperature fixability. When greater than 40% by weight, the low-temperature fixability thereof deteriorates.

Specific examples of the polyisocyanates (PIC) include aliphatic polyisocyanates such as tetramethylenediisocyanate, hexamethylenediisocyanate, 2,6-diisocyanatemethylcaproate, octamethylenediisocyanate, decamethylenediisocyanate, dodecamethylenediisocyanate, tetradecamethylenediisocyanate and trimethylhexanediisocyanate; alicyclic polyisocyanates such as isophoronediisocyanate and cyclohexylmethanediisocyanate; aromatic diisocianates such as tolylene diisocyanate, diphenylmethane diisocyanate, 1,5-naphthylene diisocyanate, diphenylene-4, 4'-diisocyanate, 4,4'-diisocyanate-3,3-dimethyl diphenyl, 3-methyldiphenylmethane-4,4'-diisocynate and diphenylether-4,4'-diisocyanate; aromatic aliphatic diisocyanates such as α,α,α', α'-tetramethylxylylenediisocyanate; isocyanurates such as tris-isocyanatealkyl-isocyanurate and triisocyanatecycloalkyl-isocyanurate; blocked polyisocyanates in which the polyisocyanates mentioned above are blocked with phenol derivatives, oximes or caprolactams; etc.

These compounds can be used alone or in combination.

Suitable mixing ratio (i.e., the equivalence ratio [NCO]/[OH]) of the [NCO] group of the polyisocyanate (PIC) to the [OH] group of the polyester resin having a group including an active hydrogen (such as a polyester resin including a hydroxyl group) is from 5/1 to 1/1, preferably from 4/1 to 1.2/1 and more preferably from 2.5/1 to 1.5/1.

When greater than 5/1, the low-temperature fixability of the resultant toner deteriorates. When less than 1/1, the offset resistance thereof deteriorates.

The polyester prepolymer including an isocyanate group (A) preferably includes the polyisocyanate (PIC) in an amount of from 0.5 to 40% by weight, more preferably from 1 to 30% by weight, and even more preferably from 2 to 20% by weight.

When less than 0.5% by weight, the hot offset resistance of the resultant toner deteriorates, which is difficult to have both thermostable preservability and low-temperature fixability. When greater than 40% by weight, the low-temperature fixability thereof deteriorates.

An average number of the isocyanate group included in the polyester prepolymer including an isocyanate group (A) per molecule is preferably not less than 1, more preferably from 1.2 to 5, and even more preferably from 1.5 to 4.

When less than 1, the polyester resin including a group formed by urea bonding (RMPE) has a lower molecular weight, and the hot offset resistance of the resultant toner deteriorates.

The tetrahydrofuran (THF) soluble components of the polymer reactable with the compound having a group including an active hydrogen preferably have a weight-average molecular weight (Mw) of from 1,000 to 30,000, and more preferably from 1,500 to 15,000 in a gel permeation chromatography. When less than 1,000, the thermostable preservability of the resultant toner deteriorates. When greater than 30,000, the low-temperature fixability thereof deteriorates.

The molecular weight is measured by GPC (gel permeation chromatography) as follows. A column is stabilized in a heat chamber having a temperature of 40° C.; THF is put into the column at a speed of 1 ml/min as a solvent; 50 to 200 μl of a THF liquid-solution of a resin, having a sample concentration of from 0.05 to 0.6% by weight, is put into the column; and a molecular weight distribution of the sample is determined by using a calibration curve which is previously prepared using several polystyrene standard samples having a single distribution peak, and which shows the relationship between a count number and the molecular weight. As the standard polystyrene samples for making the calibration curve, for example, the samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $48\times10^6$ from Pressure Chemical Co. or Tosoh Corporation are used. It is preferable to use at least 10 standard polystyrene samples. In addition, an RI (refraction index) detector is used as the detector.

Specific examples of the binder resins include a polyester resin. Particularly an unmodified polyester resin is preferably used.

The unmodified polyester resin included in a toner improves the low-temperature fixability thereof and glossiness of images produced thereby.

The unmodified polyester resin includes the examples of the polyester resin including a group formed by urea bonding (RMPE), i.e., the polycondensated products between the PO and PC. It is preferable that the unmodified polyester resin is partially compatible with the polyester resin including a group formed by urea bonding, i.e., these have a compatible similar structure because the resultant toner has good low-temperature fixability and hot offset resistance.

The tetrahydrofuran (THF) soluble components of the unmodified polyester resin preferably have a weight-average molecular weight (Mw) of from 1,000 to 30,000, and more preferably from 1,500 to 15,000 in a gel permeation chromatography. When less than 1,000, the thermostable preservability of the resultant toner deteriorates, and therefore the content of the unmodified polyester resin having weight-average molecular weight (Mw) less than 1,000 needs to be 8 to 28% by weigh. When greater than 30,000, the low-temperature fixability thereof deteriorates.

The unmodified polyester resin preferably has a glass transition temperature of from 30 to 70° C., more preferably from 35 to 60° C., and even more preferably from 35 to 50° C. When less than 30° C., the thermostable preservability of the resultant toner deteriorates. When greater than 70° C., the low-temperature fixability thereof is insufficient.

The unmodified polyester resin preferably has a hydroxyl value not less than 5 KOH mg/g, more preferably from 10 to 120 KOH mg/g, and even more preferably from 20 to 80 KOH mg/g. When less than 5 KOH mg/g, the resultant toner is difficult to have both thermostable preservability and low-temperature fixability.

The unmodified polyester resin preferably has an acid value of from 1.0 to 50.0 KOH mg/g, and more preferably from 1.0 to 30.0 KOH mg/g. The resultant toner having such an acid value typically tends to be negatively charged.

A mixing ratio (polymer/PE) by weight of the polymer reactable with the compound having a n active hydrogen such as the polyester resin including a group formed by urea bonding urea bonding (RMPE) to the unmodified polyester resin (PE) is preferably from 5/95 to 25/75, and more preferably from 10/90 to 25/75.

When the mixing ratio by weight of the PE is greater than 95, the hot offset resistance of the resultant toner deteriorates. When less than 20, the glossiness thereof deteriorates.

The content of the PE is preferably from 50 to 100% by weight, more preferably from 70 to 95%, and much more preferably from 80 to 90% by weight based on total weight of the binder resin. When less than 50% by weight, the low-temperature fixability and the glossiness of the resultant toner deteriorate.

At least two release agents are preferably used. The release agents are not particularly limited, and known release agents such as a wax can be used.

Specific examples of the wax include fatty acid ester, low-molecular-weight polyethylene, carnauba wax, etc. Among these, the carnauba wax and the fatty acid ester are preferably used, and the carnauba wax is more preferably used. The fatty acid ester and the low-molecular-weight polyethylene tend to be a spherical or a spindle-shaped island, and the carnauba wax tend to be a fibrous island.

The toner of the present invention properly includes a spherical or a spindle-shaped wax and a fibrous wax. This is same when the toner is prepared by any methods such as a pulverization method, a suspension polymerization method, an emulsification agglutination method and a solution suspension method.

The wax preferably has a softening point of from 60 to 100° C., and more preferably from 70 to90° C. When less than 60° C., hot offset resistance of the resultant toner deteriorates. When higher than 100° C., the wax is not sufficiently dispersed in the binder resin and the resultant toner tends to film over photoreceptors.

The toner preferably includes a release agent in an amount of from 1 to 10 parts by weight, and more preferably from 3 to 9 parts by weight per 100 parts by weight of the binder resin. When less than 1 part by weight, the offset resistance and oilless separability of the resultant toner deteriorate. When greater than 10 parts by weight, the release agent adheres to regulation blades and the resultant toner tends to film over photoreceptors.

Specific examples of the colorant include known dyes and pigments such as carbon black, Nigrosine dyes, black iron oxide, NAPHTHOL YELLOW S (C.I. 10316), HANSA YELLOW 10G (C.I. 11710), HANSA YELLOW 5G (C.I. 11660), HANSA YELLOW G (C.I. 11680), Cadmium Yellow, yellow iron oxide, loess, chrome yellow, Titan Yellow, polyazo yellow, Oil Yellow, HANSA YELLOW GR (C.I. 11730), HANSA YELLOW A (C.I. 11735), HANSA YELLOW RN (C.I. 11740), HANSA YELLOW R (C.I. 12710), PIGMENT YELLOW L (C.I. 12720), BENZIDINE YELLOW G (C.I. 21095), BENZIDINE YELLOW GR (C.I. 21100), PERMANENT YELLOW NCG (C.I. 20040), VULCAN FAST YELLOW 5G (C.I. 21220), VULCAN FAST YELLOW R (C.I. 21135), Tartrazine Lake, QUINOLINE YELLOW LAKE, ANTHRAZANE YELLOW BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, BRILLIANT CARMINE BS, PERMANENT RED F2R (C.I. 12310), PERMANENT RED F4R (C.I. 12335), PERMANENT RED FRL (C.I. 12440), PERMANENT RED FRLL (C.I. 12460), PERMANENT RED F4RH (C.I. 12420), Fast Scarlet VD, VULCAN FAST RUBINE B (C.I. 12320), BRILLIANT SCARLET G, LITHOL RUBINE GX (C.I. 12825), PERMANENT RED F5R, BRILLIANT CARMINE 6B, Pigment Scarlet 3B, Bordeaux 5B, Toluidine Maroon, PERMANENT BORDEAUX F2K (C.I. 12170), HELIO BORDEAUX BL (C.I. 14830), BORDEAUX 10B, BON MAROON LIGHT (C.I. 15825), BON MAROON MEDIUM (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS (C.I. 69800), INDANTHRENE BLUE BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc.

These can be used alone or in combination.

A toner preferably includes the colorant in an amount of from 1 to 15% by weight, and more preferably from 3 to 10% by weight of the toner. When less than 1% by weight, the resultant toner cannot produce images with high image density. When greater than 15 5 by weight, problems in that the resultant toner cannot produce images with high image density and has poor electrostatic properties due to defective dispersion of the colorant in the toner occur.

Masterbatches, which are complexes of a colorant with a resin, can be used as the colorant of the toner of the present invention. Specific examples of the resins for use as the binder resin of the master batch include a polymer of styrene or a styrene derivative, a styrene copolymer, polymethyl methacrylate, polybutyl methacrylate, polyvinyl chloride, polyvinyl acetate, polyethylene, polypropylene, polyester, an epoxy resin, an epoxy polyol resin, a polyurethane resin, a polyamide resin, a polyvinyl butyral resin, an acrylic resin, a rosin, a modified rosin, a terpene resin, an aliphatic or an alicyclic hydrocarbon resin, an aromatic petroleum resin, a chlorinated paraffin, a paraffin, etc. These can be used alone or in combination.

Specific examples of the polymer of styrene or a styrene derivative include polystyrene, poly-p-chlorostyrene and polyvinyltoluene. Specific examples of the styrene copolymer include a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylatecopolymer, astyrene-methyl α-chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer, a styrene-maleic acid ester copolymer, etc.

The masterbatches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three-roll mills can be preferably used.

Specific examples of the other constituents include a release agent, a charge controlling agent, a fluidity improver, a cleanability improver, a magnetic material, etc.

Known charge controlling agents can be used. However, colorless or white charge controlling agents are preferably used because colored charge controlling agents change the color tone of a toner. Specific examples thereof include triphenylmethane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These can be used alone or in combination.

Specific examples of marketed charge controlling agents include BONTRON P-51 (quaternary ammonium salt), BONTRON E-82 (metal complex of oxynaphthoic acid), BONTRONE-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boroncomplex), which are manufactured by Japan Carlit Co., Ltd.; quinacridone, azo pigments, and polymers having a functional group such as a sulfonate group, a carboxyl group, a quaternary ammonium group, etc.

The charge controlling agent can be included in the toner by a method in which a mixture of the charge controlling agent and the masterbatch, which have been melted and kneaded, is dissolved or dispersed in a solvent and the resultant solution or dispersion is dispersed in an aqueous medium to prepare a toner dispersion or a method in which the charge controlling agent is dissolved or dispersed together with other toner constituents to prepare a toner constituent mixture liquid and the mixture liquid is dispersed in an aqueous medium to prepare a toner dispersion. Alternatively, the charge controlling agent can be fixed on a surface of the toner after toner particles are prepared.

The content of the charge controlling agent in the toner is determined depending on the variables such as choice of binder resin, presence of additives, and dispersion method. In general, the content of the charge controlling agent is preferably from 0.1 to 10 parts by weight, and more preferably from 1 to 5 parts by weight, per 100 parts by weight of the binder resin included in the toner. When the content is too low, a good charge property cannot be imparted to the toner. When the content is too high, the charge quantity of the toner excessively increases, and thereby the electrostatic attraction between the developing roller and the toner increases, resulting in deterioration of fluidity and decrease of image density.

Any known thermoplastic or thermosetting resins which can form a dispersion in an aqueous medium can be used as the particulate resin. Specific examples thereof include a vinyl resin, a polyurethane resins, an epoxy resins, a polyester resin, a polyamide resin, a polyimide resin, a silicone resin, a phenolic resin, a melamine resin, a urea resin, an aniline resin, an ionomer resin, a polycarbonate resins, etc.

These resins can be used alone or in combination. Among these resins, at least one of the vinyl resins, the polyurethane resins, the epoxy resins and the polyester resins is preferably used because an aqueous dispersion including a microscopic spherical particulate resin can easily be prepared with the resin.

Specific examples of the vinyl resins include homopolymerized or copolymerized polymers such as styrene-(metha) esteracrylate resins, styrene-butadiene copolymers, (metha) acrylic acid-esteracrylate polymers, styrene-acrylonitrile copolymers, styrene-maleic acid anhydride copolymers and styrene-(metha)acrylic acid copolymers.

As the particulate resin, a copolymer including a monomer having at least two unsaturated groups can also be used.

The monomer having at least two unsaturated groups is not particularly limited, and can be selected in accordance with the purpose. Specific examples thereof include a sodium salt of a sulfate ester with an additive of ethylene oxide methacrylate (ELEMINOL RS-30 from Sanyo Chemical Industries, Ltd.), divinylbenzene, 1,6-hexanediolacrylate, etc.

The particulate resin can be prepared by any known polymerization methods, however, preferably prepared in the form of an aqueous dispersion thereof. The aqueous dispersion thereof can be prepared by the following methods:

(1) a method of directly preparing an aqueous dispersion of a vinyl resin from a vinyl monomer by a suspension polymerization method, an emulsification polymerization method, a seed polymerization method or a dispersion polymerization method;

(2) a method of preparing an aqueous dispersion of polyaddition or polycondensation resins such as a polyester resin, a polyurethane resin and an epoxy resin by dispersing a precursor (such as a monomer and an oligomer) or a solution thereof in an aqueous medium under the presence of a dispersant to prepare a dispersion, and heating the dispersion or adding a hardener thereto to harden the dispersion;

(3) a method of preparing an aqueous dispersion of polyaddition or polycondensation resins such as a polyester resin, a polyurethane resin and an epoxy resin by dissolving an emulsifier in a precursor (such as a monomer and an oligomer) or a solution (preferably a liquid or may be liquefied by heat) thereof to prepare a solution, and adding water thereto to subject the solution to a phase-inversion emulsification;

(4) a method of pulverizing a resin prepared by any polymerization methods such as addition condensation, ring scission polymerization, polyaddition and condensation polymerization with a mechanical or a jet pulverizer to prepare a pulverized resin and classifying the pulverized resin to prepare a particulate resin, and dispersing the particulate resin in an aqueous medium under the presence of a dispersant;

(5) a method of spraying a resin solution wherein a resin prepared by any polymerization methods such as addition condensation, ring scission polymerization, polyaddition and condensation polymerization is dissolved in a solvent to prepare a particulate resin, and dispersing the particulate resin in an aqueous medium under the presence of a dispersant;

(6) a method of adding a lean solvent in a resin solution wherein a resin prepared by any polymerization methods such as addition condensation, ring scission polymerization, polyaddition and condensation polymerization is dissolved in a solvent, or cooling a resin solution wherein the resin is dissolved upon application of heat in a solvent to separate out a particulate resin and removing the solvent therefrom, and dispersing the particulate resin in an aqueous medium under the presence of a dispersant;

(7) a method of dispersing a resin solution, wherein a resin prepared by any polymerization methods such as addition condensation, ring scission polymerization, polyaddition and condensation polymerization is dissolved in a solvent, in an aqueous medium under the presence of a dispersant, and removing the solvent upon application of heat or depressure; and (8) a method of dissolving an emulsifier in a resin solution wherein a resin prepared by any polymerization methods such as addition condensation, ring scission polymerization, polyaddition and condensation polymerization is dissolved in a solvent, and adding water thereto to subject the solution to a phase-inversion emulsification.

The toner of the present invention can be prepared by known methods such as a suspension polymerization method, an emulsification agglutination method and an emulsification dispersion method, and a toner prepared by a method of dissolving or dispersing toner constituents comprising a compound including a group having an active hydrogen and a polymer reactable therewith in an organic solvent to prepare a solution, dispersing or emulsifying the solution in an aqueous medium to prepare a dispersion, and removing the organic solvent from the dispersion is preferably used.

Any known solvents can be used, provided the toner constituents can be dissolved or dispersed therein. The solvent is preferably volatile and has a boiling point lower than 150° C. because of easily removed. Specific examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used. Particularly, the ethyl acetate is more preferably used.

The usage thereof is preferably from 40 to 300 parts by weight, more preferably from 60 to 140, and even more preferably from 80 to 120 parts by weight, per 100 parts by weight of the toner constituents.

The solution or dispersion prepared by dissolving or dispersing the toner constituents in the organic solvent is emulsified or dispersed in the aqueous medium, wherein a reaction between the compound having a group including an active hydrogen and the polymer reactable therewith is performed.

Specific examples of the aqueous medium include water, a water-soluble solvent, a mixture thereof, etc. Particularly, water us preferably used.

Specific examples of the water-soluble solvents include alcohols such as methanol, isopropanol and ethylene glycol; dimethylformamide; tetrahydrofuran; cellosolves; lower ketones such as acetone and methyl ethyl ketone; etc.

These can be used alone or in combination.

The dispersion method is not particularly limited, and known mixers and dispersers such as a low shearing-force disperser, a high shearing-force disperser, a friction disperser, a high-pressure jet disperser and an ultrasonic disperser can be used. In order to prepare the toner for use in the present invention, it is preferable to prepare an emulsion including particles having an average particle diameter of from 2 to 20 μm. Therefore, the high shearing-force disperser is preferably used.

When the high shearing-force disperser is used, the rotation speed of rotors thereof is not particularly limited, but the rotation speed is typically from 1,000 to 30,000 rpm, and preferably from 5,000 to 20,000 rpm. In addition, the dispersion time is also not particularly limited, but the dispersion time is typically from 0.1 to 5 minutes. The temperature in the dispersion process is typically 0 to 150° C. (under pressure), and preferably from 40 to 98° C. The processing temperature is preferably as high as possible because the viscosity of the dispersion decreases and thereby the dispersing operation can be easily performed.

An embodiment of the method of preparing a toner by granulating the adhesive base material.

The method includes preparation of the aqueous medium, preparation of the solution or dispersion of the toner constituents, emulsification or dispersion of the solution or dispersion of the toner constituents in the aqueous medium, production of a binder resin formed of the reaction between the compound having a group including an active hydrogen and the polymer reactable therewith, removal of the organic solvent, synthesis of the polymer reactable with the compound having a group including an active hydrogen (prepolymer), synthesis of the compound having a group including an active hydrogen, etc.

The particulate resin is dispersed in the aqueous medium. The aqueous medium preferably includes the particulate resin in an amount of from 0.5 to 10% by weight.

The solution or dispersion of the toner constituents can be prepared by dissolving or dispersing toner constituents such as the compound having a group including an active hydrogen, the polymer reactable therewith, the crystalline resin, the colorant, the release agent, the charge controlling agent, the unmodified polyester resin in the organic solvent.

The toner constituents besides the polymer reactable with the compound having a group including an active hydrogen (prepolymer) may be added the aqueous medium when the particulate resin is dispersed therein or when the solution or dispersion of the toner constituents is added to the aqueous medium.

When the solution or dispersion of the toner constituents is emulsified or dispersed in the aqueous medium, the compound having a group including an active hydrogen and the polymer reactable therewith are subjected to an elongation or crosslinking reaction to produce the adhesive base material.

The adhesive base material such as the urea-modified polyester resin may be produced by (1) emulsifying or dispersing the solution or dispersion of the toner constituents including the polymer reactable with the compound having a group including an active hydrogen such as the prepolymer including an isocyanate group (A) with the compound having a group including an active hydrogen such as the amines (B) in the aqueous medium to be subjected to an elongation or a crosslinking reaction; (2) emulsifying or dispersing the solution or dispersion of the toner constituents in the aqueous medium previously including the compound having a group including an active hydrogen to be subjected to an elongation or a crosslinking reaction; and (3) emulsifying or dispersing the solution or dispersion of the toner constituents in the aqueous medium, and adding the compound having a group including an active hydrogen thereto to be subjected to an elongation or a crosslinking reaction, wherein the modified polyester is preferentially formed on the surface of the toner, which can have a concentration gradient thereof.

The reaction time of the elongation or crosslinking reaction between the compound having a group including an active hydrogen and the polymer reactable therewith is preferably from 10 min to 40 hrs, and more preferably from 2 to 24 hrs. The reaction temperature is preferably from 0 to 150° C., and more preferably from 40 to 98° C.

Methods of stably forming the dispersion including the polymer reactable with the compound having a group including an active hydrogen, such as the polyester prepolymer including an isocyanate group (A) in the aqueous medium include, e.g., a method of adding the solution or dispersion prepared by dissolving or dispersing the polymer reactable with the compound having a group including an active hydrogen such as the polyester prepolymer including an isocyanate group (A), the colorant, the release agent, the charge controlling agent and the unmodified polyester resin in the organic solvent, into the aqueous medium, and dispersing the solution or dispersion therein with a shearing force.

In order to stabilize the dispersion (oil drops of the solution or dispersion of the toner constituents) and sharpen a particle diameter thereof while forming a desired shape thereof, a dispersant is preferably used.

Specific examples of the dispersant include a surfactant, an inorganic dispersant hardly soluble in water, a polymer protective colloid, etc. These can be used alone or in combination, and the surfactant is preferably used.

The surfactants include anionic surfactants, cationic surfactants, nonionic surfactants, ampholytic surfactants, etc.

Specific examples of the anionic surfactants include an alkylbenzene sulfonic acid salt, an α-olefin sulfonic acid salt, a phosphoric acid salt, etc., and anionic surfactants having a fluoroalkyl group are preferably used. Specific examples thereof include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, saltsofperfluoroalkyl (C6-C10) -N-ethylsulfonylglycin, monoperfluoroalkyl(C6-C16)ethylphosphates, etc. Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd. ; UNIDYNE®DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants include amine salts such as an alkyl amine salt, an aminoalcohol fatty acid derivative, a polyamine fatty acid derivative and an imidazoline; and quaternary ammonium salts such as an alkyltrimethyl ammonium salt, a dialkyldimethyl ammonium salt, an alkyldimethyl benzyl ammonium salt, a pyridinium salt, an alkyl isoquinolinium salt and a benzethonium chloride. Among the cationic surfactants, primary, secondary and tertiary aliphatic amines having a fluoroalkyl group, aliphatic quaternary ammonium salts such as perfluoroalkyl(C6-C10) sulfoneamidepropyltrimethylammonium salts, benzalkonium salts, benzetonium chloride, pyridinium salts, imidazolinium salts, etc. are preferably used. Specific examples of the marketed products thereof include SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Specific examples of the nonionic surfactants include a fatty acid amide derivative, a polyhydric alcohol derivative, etc.

Specific examples of the ampholytic surfactants include alanine, dodecyldi(aminoethyl)glycin, di(octylaminoethyle) glycin, and N-alkyl-N,N-dimethylammonium betaine, etc.

Specific examples of the inorganic surfactants hardly soluble in water include tricalcium phosphate, calcium carbonate, colloidal titanium oxide, colloidal silica, and hydroxyapatite.

Specific examples of the protective colloids include polymers and copolymers prepared using monomers such as acids (e.g., acrylic acid, methacrylic acid, α-cyanoacrylic acid, α-cyanomethacrylicacid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

In addition to the dispersants, a dispersion stabilizer is optionally used. Specific examples thereof include acid and alkali-soluble materials such as calcium phosphate.

It is preferable to dissolve the dispersant with hydrochloric acid to remove that from the toner particles, followed by washing. In addition, it is possible to remove such a dispersant by decomposing the dispersant using an enzyme.

In addition, known catalysts such as dibutyltin laurate and dioctyltin laurate can be used for the elongation and crosslinking reaction, if desired.

The organic solvent is removed from the dispersion (emulsified slurry) by (1) a method of gradually heating the dispersion to completely evaporate the organic solvent in the oil drop and (2) a method of spraying the emulsified dispersion in a dry atmosphere to completely evaporate the organic solvent in the oil drop and to evaporate the aqueous dispersant, etc.

When removed, toner particles are formed. The toner particles are washed, dried and further classified if desired. The toner particles are classified by removing fine particles with a cyclone, a decanter, a centrifugal separator, etc. in the dispersion. Alternatively, the toner particles may be classified as a powder after dried.

The thus prepared dry toner particles can be mixed with one or more other particulate materials such as external additives mentioned above, release agents, charge controlling agents, fluidizers and colorants optionally upon application of mechanical impact thereto to fix the particulate materials on the toner particles.

Specific examples of such mechanical impact application methods include methods in which a mixture is mixed with a highly rotated blade and methods in which a mixture is put into a jet air to collide the particles against each other or a collision plate. Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

The toner preferably has the following glass transition temperature (Tg), volume-average particle diameter (Dv), volume-average particle diameter (Dv)/number-average particle diameter (Dn), average circularity, etc.

The toner preferably has a glass transition temperature of from 40 to 70° C., and more preferably from 45 to 65° C.

When less than 40° C., the thermostable preservability of the toner deteriorates. When higher than 70° C., the low-temperature fixability thereof deteriorates.

The toner preferably has a volume-average particle diameter (Dv) of from 3 to 8 μm, more preferably from 4 to 7 μm, and much more preferably from 5 to 6 μm. The volume-average particle diameter (Dv) is specified as follows:

$$Dv=[(\Sigma(nD^3)/\Sigma n)^{1/3}$$

wherein n represents the number of particles, and D represents a particle diameter.

When less than 3 μm, the toner is fusion-bonded to the surface of a carrier when used in a two-component developer, resulting in deterioration of the chargeability of the carrier, and filming thereof over a developing roller and fusion bond thereof to a blade forming a thin layer thereof tend to occur when used as a one-component developer. When greater than 8 μm, the toner is difficult to produce high definition and high-quality images, and largely varies in the particle diameter when the toner is consumed and fed in the developer.

The toner preferably has a ratio (Dv/Dn) of the volume-average particle diameter (Dv) to a number-average particle diameter (Dn) of from 1.00 to 1.15.

When the Dv/Dn is not greater than 1.15, the toner has comparatively a sharp particle diameter distribution and the fixability thereof improves. When less than 1.00, the toner is fusion-bonded to the surface of a carrier when used in a two-component developer, resulting in deterioration of the chargeability of the carrier, and filming thereof over a developing roller and fusion bond thereof to a blade forming a thin layer thereof tend to occur when used as a one-component developer.

The (Dv) and the ratio (Dv)/(Dn) can be measured by MULTISIZER II from Beckman Coulter, Inc.

The average circularity is determined by dividing a circumferential length of a circle having an area equivalent to a projected area of the toner with a length of the actual particle, and is preferably from 0.93 to 0.97.

When less than 0.93, the toner becomes amorphous and has difficulty in having sufficient transferability and producing high-quality images without a toner dust. When greater than 0.97, an image forming apparatus using blade cleaning has poor cleaning on a photoreceptor and a transfer belt. For example, when images having a large image area such as photo images are produced, untransferred toner occasionally remains on the photoreceptor, resulting in background fouling and contamination of a charging roller.

The average circularity of the toner can be measured by an optical detection method of passing a suspension including a particle through a tabular imaging detector and optically detecting and analyzing the particle image with a CCD camera is suitably used, such as a flow-type particle image analyzer FPIA-2000 from SYSMEX CORPORATION.

Colors of the toner are not particularly limited, and can be selected from at least one of black, cyan, magenta and yellow.

The developer of the present invention includes at least the toner, and optionally other components such as a carrier. The developer may be a one-component developer or a two-component developer, however, the two-component developer having a long life is preferably used in high-speed printers in compliance with the recent high information processing speed.

Even the one-component developer or two-component developer has less variation of particle diameter of the toner even after repeatedly used, good and stable developability and produces quality images for long periods without filming over a developing roller and fusion bonding to a member such as a blade forming a thin layer of the toner.

The developer including the toner of the present invention has good offset resistance and separability, no problem of filming over photoreceptors, and can produce high-definition images with quite little toner adherence to developer bearers and regulators even when used as a non-magnetic one-component developer.

The developer of the present invention can preferably be used in known electrophotographic image forming methods such as a magnetic one-component developing method, a non-magnetic one-component developing method and a two-component developing method. Particularly, the developer of the present invention can preferably be used in the following toner container, process cartridge, image forming apparatus and image forming method of the present invention.

The toner container of the present invention contains the toner or the developer of the present invention.

The container is not particularly limited, and can be selected from known containers such as a container having a cap. The size, shape, structure, material, etc. thereof are not particularly limited, and can be selected in accordance with the purpose. The container preferably has the shape of a cylinder, and particularly, the cylinder preferably has a spiral concavity and convexity on the inside surface thereof such that a toner can transfer to an exit thereof when the cylinder rotates. In addition, apart or the all of the spiral is preferably a cornice.

The materials for the container are not particularly limited, and resins having good size precision are preferably used, such as polyester resins, polyethylene resins, polypropylene resins, polystyrene resins, polyvinylchloride resins, polyacrylate resins, polycarbonate resins, ABS resins and polyacetal resins.

The toner container of the present invention is easy to store, transport and handle, and is detachable from the process cartridge and the image forming apparatus of the present invention mentioned later, to feed the toner thereto.

The process cartridge of the present invention includes at least an electrostatic latent image bearer bearing an electrostatic latent image and an image developer developing the electrostatic latent image with a developer to form a visible image, and optional other means. The image developer includes at least a developer container containing the toner or developer of the present invention and a developer bearer bearing the toner or developer contained in the container, and further may include a layer thickness regulator regulating a layer thickness of the toner.

The process cartridge of the present invention can be detachable from various electrophotographic image forming apparatuses such as a facsimile and a printer, and is preferably detachable from the image forming apparatus of the present invention mentioned later.

Figure 3:
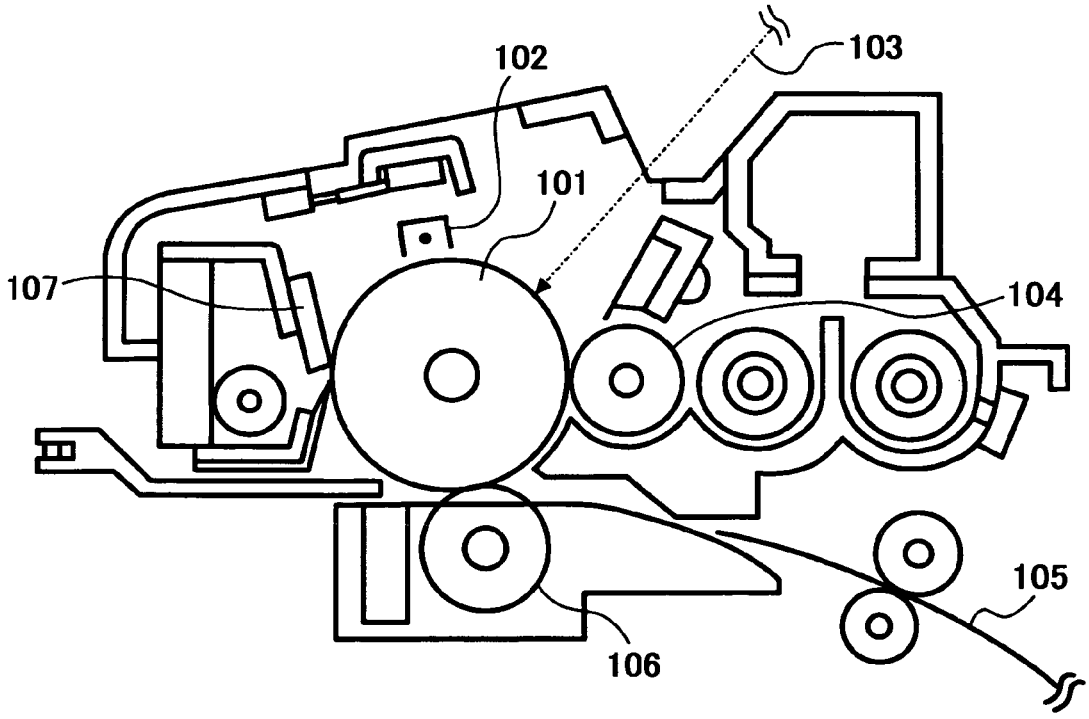
FIG. 3 is a schematic view illustrating an embodiment of the process cartridge of the present invention.

The process cartridge includes, as shown in FIG. 3, a photoreceptor 101 and at least one of a charger 102, an irradiator 103, an image developer 104, a cleaner 107 and other means. Numeral 105 is a recording medium and 106 is a transfer roller.

The photoreceptor 101 is the electrostatic latent image bearer of the present invention.

The charger 102 may be any conventional charger.

The an irradiator 103 uses a light source capable of writing a high-resolution electrostatic latent image.

The image forming apparatus of the present invention may include the electrostatic latent image bearer and at least one of components such as an image developer and a cleaner as a process cartridge in a body, which is detachable therefrom.

Alternatively, a process cartridge including the electrostatic latent image bearer and at least one of a charger, an irradiator, an image developer, a transferer or separator, and a cleaner may be detachable from the image forming apparatus through a guide rail or the like.

The image forming method of the present invention includes at least an electrostatic latent image forming process, a development process, a transfer process and a fixing process; and optionally includes other processes such as a discharge process, a cleaning process, a recycle process and a control process.

The image forming method of the present invention is preferably performed by the image forming apparatus of the present invention. The electrostatic latent image forming process is performed by the electrostatic latent image former. The development process is performed by the image developer. The transfer process is performed by the transferer. The fixing process is performed by the fixer. The other processes are performed by the other means.

The material, shape, structure, size, etc. of the electrostatic latent image bearer (a photoreceptor) are not particularly limited, and can be selected from known electrostatic latent image bearers. However, the electrostatic latent image bearer preferably has the shape of a drum, and the material is preferably an inorganic material such as amorphous silicon and serene, and an organic material such as polysilane and phthalopolymethine. Among these materials, the amorphous silicon having a long life is preferably used.

The electrostatic latent image is formed by uniformly charging the surface of the electrostatic latent image bearer and irradiating image wise light onto the surface thereof with the electrostatic latent image former.

The electrostatic latent image former includes at least a charger uniformly charging the surface of the electrostatic latent image bearer and an irradiator irradiating image wise light onto the surface thereof.

The surface of the electrostatic latent image bearer is charged with the charger upon application of voltage.

The charger is not particularly limited, and can be selected in accordance with the purpose, such as an electroconductive or semiconductive rollers, bushes, films, known contact chargers with a rubber blade, and non-contact chargers using a corona discharge such as corotron and scorotron.

The surface of the electrostatic latent image bearer is irradiated with the imagewise light by the irradiator.

The irradiator is not particularly limited, and can be selected in accordance with the purpose, provided that the irradiator can irradiate the surface of the electrostatic latent image bearer with the imagewise light, such as reprographic optical irradiators, rod lens array irradiators, laser optical irradiators and a liquid crystal shutter optical irradiators.

In the present invention, a backside irradiation method irradiating the surface of the electrostatic latent image bearer through the backside thereof may be used.

The development process is a process of forming a visible image by developing the electrostatic latent image with the toner or developer of the present invention.

The image developer is not particularly limited, and can be selected from known image developers, provided that the image developer can develop with the toner or developer of the present invention. For example, an image developer including the toner container containing the toner or developer of the present invention and being capable of imparting the toner or developer to the electrostatic latent image while contacting or not contacting thereto, is preferably used.

The image developer may use a dry developing method or a wet developing method, and may develop a single color or multiple colors. For example, an image developer including a stirrer stirring the toner or developer to be charged and a rotatable magnet roller is preferably used.

In the image developer, the toner and the carrier are mixed and stirred, and the toner is charged and held on the surface of the rotatable magnet roller in the shape of an ear to form a magnetic brush. Since the magnet roller is located close to the electrostatic latent image bearer (photoreceptor), a part of the toner is electrically attracted to the surface thereof. Consequently, the electrostatic latent image is developed with the toner to form a visible image thereon.

It is preferable that the visible image is firstly transferred onto an intermediate transferer and secondly transferred onto a recording medium thereby. It is more preferable that two or more visible color images are firstly and sequentially transferred onto the intermediate transferer and the resultant complex full-color image is transferred onto the recording medium thereby.

The visible image is transferred by the transferer using a transfer charger charging the electrostatic latent image bearer (photoreceptor). The transferer preferably includes a first transferer transferring the two or more visible color images onto the intermediate transferer and a second transferer transferring the resultant complex full-color image onto the recording medium.

The intermediate transferer is not particularly limited, and can be selected from known transferers in accordance with the purpose, such as a transfer belt.

The transferer may be one, or two or more, and includes a corona transferer using a corona discharge, a transfer belt, a transfer roller, a pressure transfer roller, an adhesive roller, etc.

The recording medium is not particularly limited, and can be selected from known recording media, e.g., typically a plain paper and even a PET film for OHP.

The visible image transferred onto the recording medium is fixed thereon by a fixer. Each color toner image or the resultant complex full-color image may be fixed thereon.

The fixer is preferably an oilless fixer passing a recording sheet (paper) bearing a toner image on through a contact point between a heater and a pressurizer or a pressure heater pressed against the heater without applying an oil to or impregnating an oil with the pressurizer or pressure heater. Further, the heater is preferably formed of fluorine-containing resins such as a tetrafluoroethylene-perfluoroalkylvinylethe copolymer resin (PFA) and a polyvinylidene-fluoride resin in terms of improving the separability between the paper and heater.

The fixer is not particularly limited, and includes a combination of an endless belt and a roller, a combination of two rollers, etc., provided they form a nip while contacting to each other. In terms of reducing a warm-up time to save energy, the combination of an endless belt and a roller and heating by an induction heating from the surface of the fixer are preferably used.

The combination of an endless belt and a roller includes a combination of a heat roller, a pressure roller and an endless belt. The combination of two rollers includes a combination of a heat roller and a pressure roller.

When the fixer is an endless belt, the endless belt is preferably formed of a material having a small heat capacity, e.g., the endless belt includes an offset prevention layer on a substrate. The substrate is formed of nickel, polyimide, etc. The offset prevention layer is formed of a silicone rubber, a fluorine-containing resin, etc.

When the fixer is a roller, the roller preferably has a metallic core formed of an inelastic material preventing deformation (bending) due to high pressures. The inelastic material is not particularly limited, and highly heat-conductive materials such as aluminum, iron, stainless and brass. The roller is preferably coated with an offset prevention layer. The offset prevention layer is formed of a RTV silicone rubber, tetrafluoroethylene-perfluoroalkylvinylether copolymer resin (PFA), polytetrafluoroethylene (PTFE), etc.

The fixer may have a heater, and at least a part of at least one of the fixing elements is preferably heated by the heater. The heater is not particularly limited, and includes an electromagnetic induction heater.

The electromagnetic induction heater is not particularly limited, and preferably includes an induction coil located close to the fixer (such as a heat roller), a shield layer the induction coil is formed on, and an insulative layer located on the other side of the shield layer. Then, the heat roller is preferably formed of a magnetic material, a heat pipe, etc.

The induction coil is preferably located covering at least a half-cylindrical part of the heat roller on the other side of a contact point between the heat roller and the fixer (such as a pressure roller and an endless belt).

The surface temperature of the fixer is not particularly limited, and preferably from 120 to 170° C., and more preferably from 120 to 160° C. When less than 120° C., the fixability of the resultant toner is insufficient. Energy saving is not performed at higher than 170° C.

Figure 2:
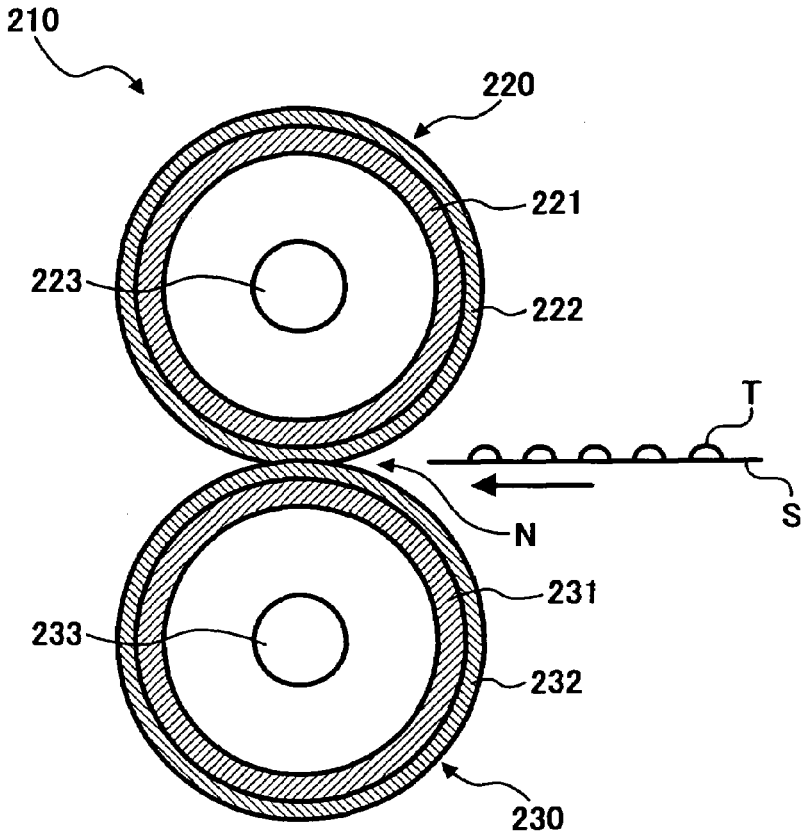
FIG. 2 is a schematic view illustrating an embodiment of the fixer of the present invention.

FIG. 2 is a preferred embodiment of the fixer. A heat roller 220, having an outer diameter of 40 mm, includes an aluminum core 223, an elastic layer 221 formed of a silicone rubber, having thickness of 1.5 mm on the aluminum core, a PFA (tetrafluoroethylene-perfluoroalkylvinylether copolymer) surface layer 222 on the elastic layer 221 and a heater in the aluminum core.

A pressure roller 230, having an outer diameter of 35 mm, includes an aluminum core 223, an elastic layer 231 formed of a silicone rubber, having thickness of 3 mm on the aluminum core and a PFA surface layer 232 on the elastic layer 231. A nip N (having a width of 7 mm) I formed between the heat roller 220 and the pressure roller 230. A fixer 210 includes a separation pick, a cleaning web cleaning the surface of the heat roller, a web roller rolling the cleaning web and a roll roller taking up the cleaning web, and does not use a fixing oil. As shown in FIG. 2, a recording sheet bearing a toner image T passes through a contact point between the heat roller 220 and pressure roller 230 to fix the toner image T on the recording sheet.

The electrostatic latent image bearer is discharged by a discharger upon application of discharge bias.

The discharger is not particularly limited, and can be selected from known dischargers, provide that the discharger can apply the discharge bias to the electrostatic latent image bearer, such as a discharge lamp.

The toner remaining on the electrostatic latent image bearer is preferably removed by a cleaner.

The cleaner is not particularly limited, and can be selected from known cleaners, provide that the cleaner can remove the toner remaining thereon, such as a magnetic brush cleaner, an electrostatic brush cleaner, a magnetic roller cleaner, a blade cleaner, a brush cleaner and a web cleaner.

The toner removed by the cleaner is recycled into the image developer with a recycler.

The recycler is not particularly limited, and known transporters can be used.

The controller is not particularly limited, and can be selected in accordance with the purpose, provided the controller can control the above-mentioned means, such as a sequencer and a computer.

Figure 4:
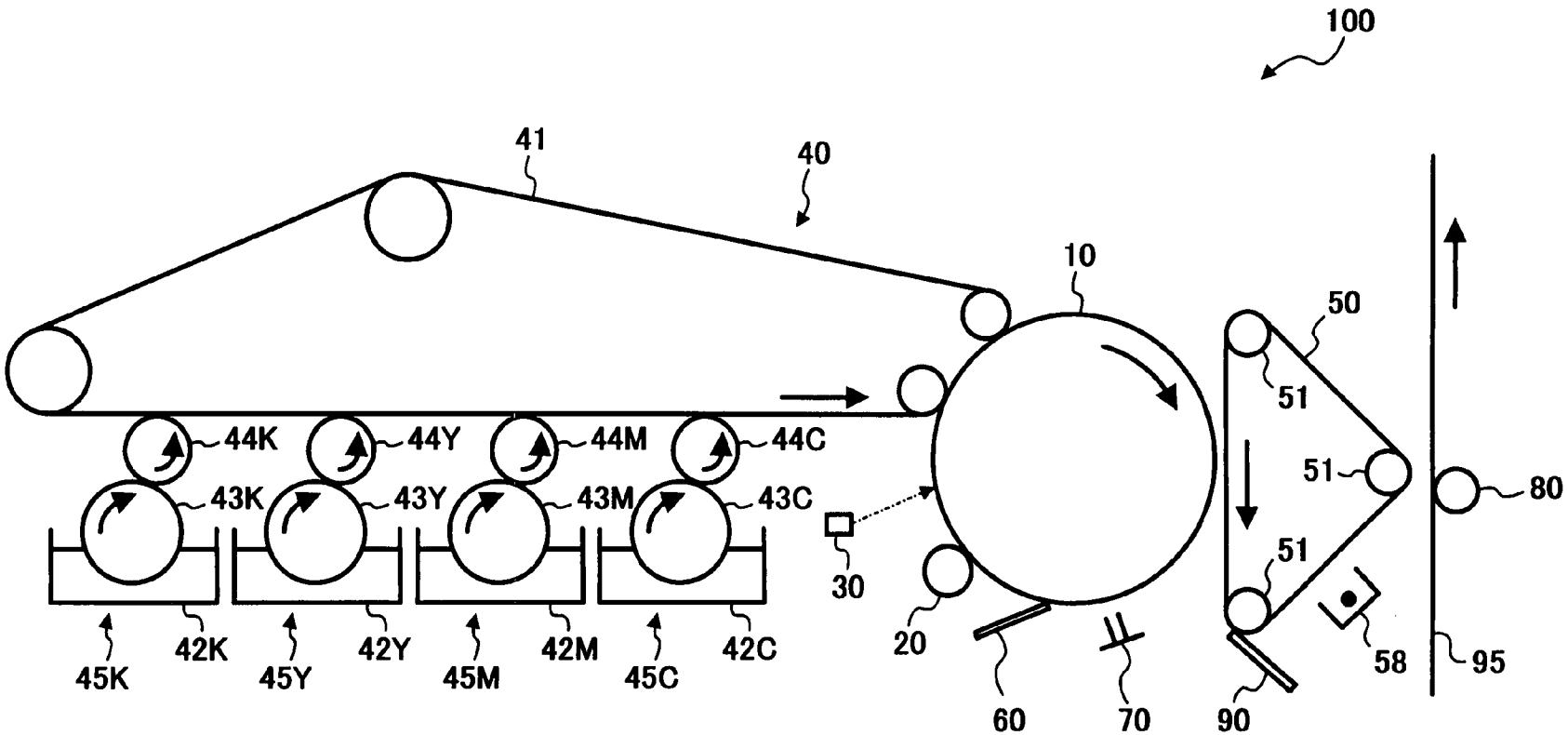
FIG. 4 is a schematic view illustrating an embodiment of the image forming apparatus of the present invention.

FIG. 4 is a schematic view illustrating an embodiment of the image forming apparatus of the present invention. An image forming apparatus 100 therein includes a photoreceptor drum 10 (hereinafter referred to as a photoreceptor 10) as an electrostatic latent image bearer, a charging roller as a charger 20, an irradiator 30, an image developer 40, an intermediate transferer 50, a cleaner 60 having a cleaning blade and a discharge lamp 70 as a discharger.

The intermediate transferer 50 is an endless belt suspended and extended by here rollers 51, and is transportable in the direction indicated by an arrow. The three rollers 51 partly work as a transfer bias roller capable of applying a predetermined first transfer bias to the intermediate transferer 50. A cleaner 90 having a cleaning blade is located close thereto and a transfer roller 80 capable of applying a transfer bias to a transfer paper 95 as a final transfer material to transfer (second transfer) the toner image thereon is located at the other side of the transfer paper 9. Around the intermediate transferer 50, a corona charge charging the toner image thereon is located.

The image developer 40 includes a developing belt 41 as a developer bearer, a black developing unit 45K, a yellow developing unit 45, a magenta developing unit 45M and a cyan developing unit 45C around the developing belt 41.

The black developing unit 45K includes a developer container 42K, a developer feed roller 43K and a developing roller 44K; the yellow developing unit 45Y includes a developer container 42Y, a developer feed roller 43Y and a developing roller 44Y; the magenta developing unit 45M includes a developer container 42M, a developer feed roller 43M and a developing roller 44M; and the cyan developing unit 45C includes a developer container 42C, a developer feed roller 43C and a developing roller 44C. The developing belt 41 is an endless belt rotatably suspended and extended by plural rollers, and partly contacts the photoreceptor 10.

The charging roller 20 uniformly charges the photoreceptor 10. The irradiator 30 irradiates imagewise light to the photoreceptor 10 to form an electrostatic latent image thereon. The electrostatic latent image formed thereon is developed with a toner fed from the image developer 40 to form a visible image (toner image) thereon. The visible image (toner image) is transferred (first transfer) onto the intermediate transferer 50 with a voltage applied from the roller 51, and is further transferred (second transfer) onto a transfer paper 95. The toner remaining on the photoreceptor 10 is removed by a cleaner 60, and the photoreceptor 10 is discharged by the discharge lamp 70.

Figure 5:
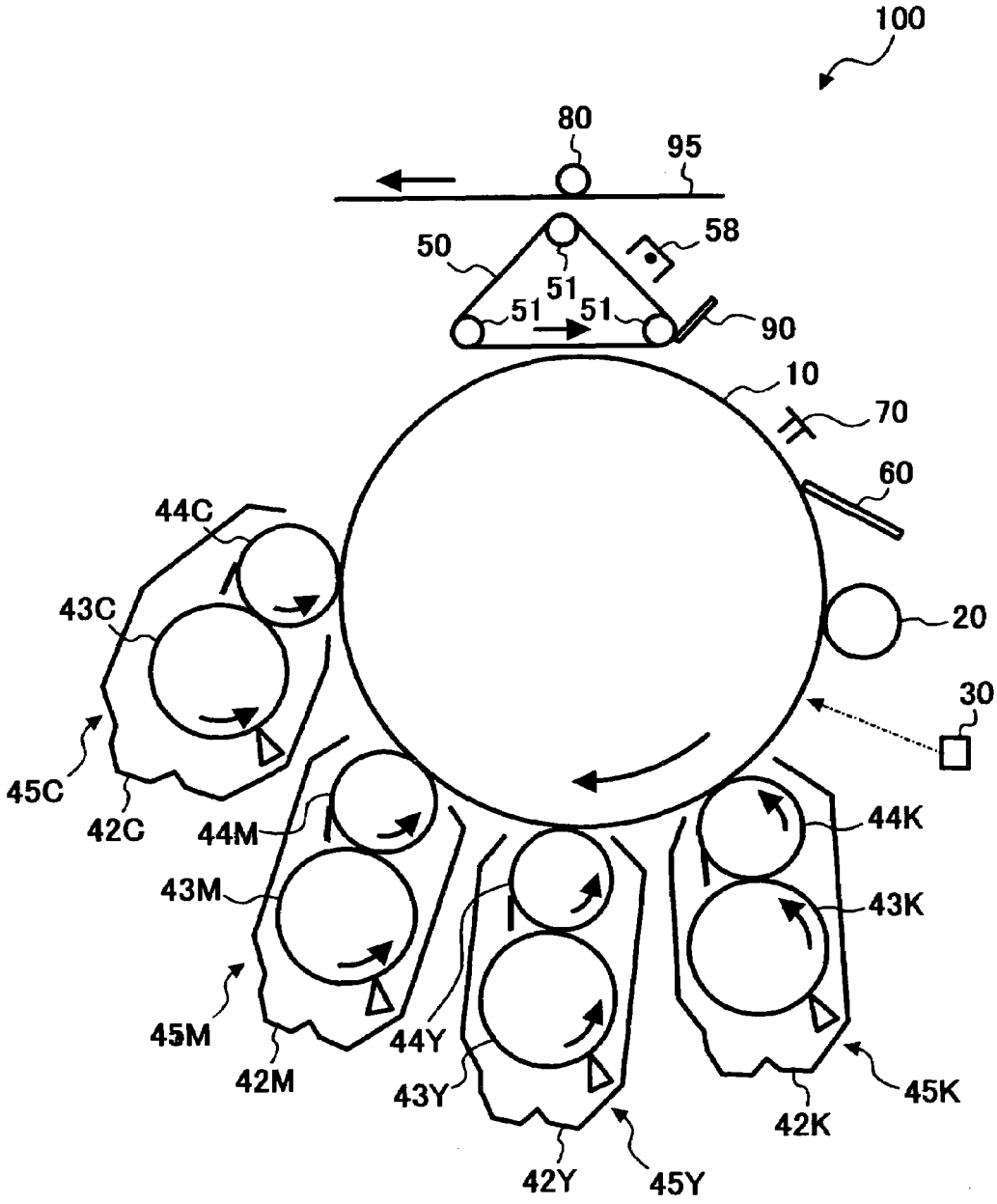
FIG. 5 is a schematic view illustrating another embodiment of the image forming apparatus of the present invention.

FIG. 5 is a schematic view illustrating another embodiment of the image forming apparatus of the present invention. The image forming apparatus therein has the same constitutions as that of FIG. 4 except that the developing belt 41 is not located and the black developing unit 45K, yellow developing unit 45Y, magenta developing unit 45M and cyan developing unit 45C are located around the photoreceptor 10, facing thereto. The same elements therein have the same numbers as those in FIG. 4.

Figure 6:
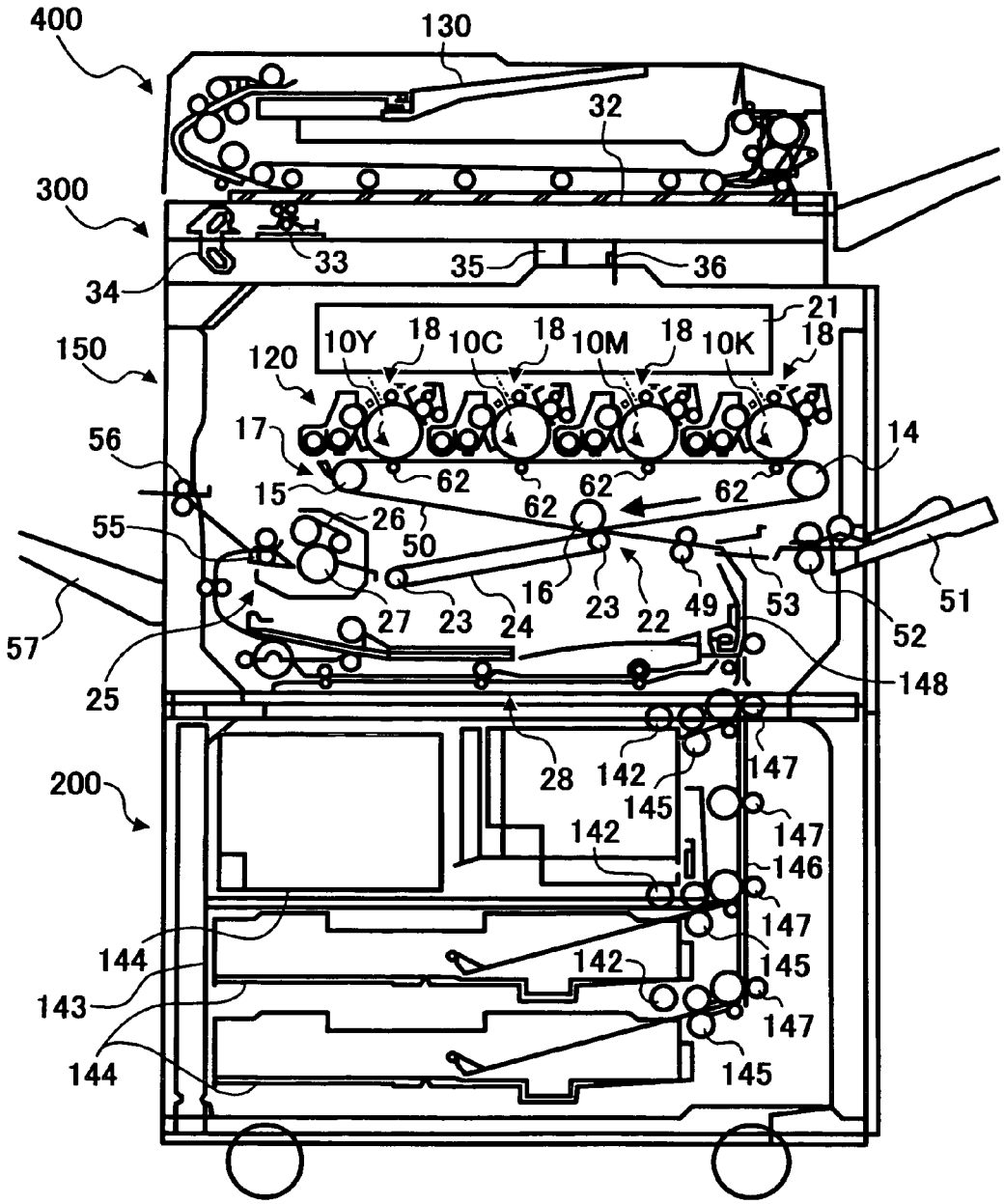
FIG. 6 is a schematic view illustrating a tandem full-color image forming apparatus of the present invention.
Figure 7:
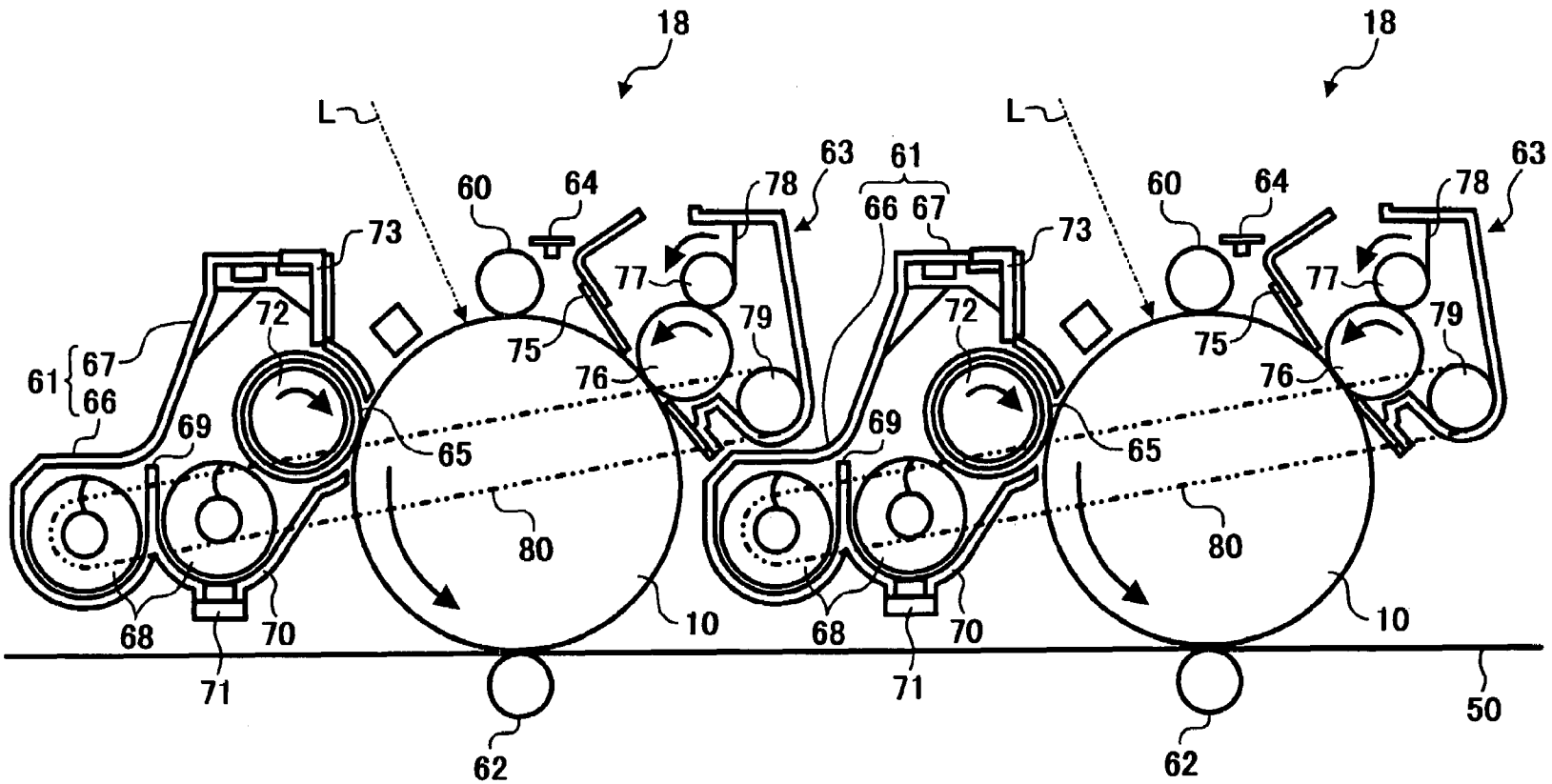
FIG. 7 is a schematic enlarged view illustrating a part of the image forming apparatus in FIG. 6.

FIG. 6 is a schematic view illustrating a tandem full-color image forming apparatus of the present invention. The tandem image forming apparatus 100 includes a duplicator 150, a paper feeding table 200, a scanner 300 and an automatic document feeder (ADF) 400.

The duplicator 150 includes an intermediate transferer 50 having the shape of an endless belt. The intermediate transferer 50 is suspended by three suspension rollers 14, 15 and 16 and rotatable in a clockwise direction. On the left of the suspension roller 15, an intermediate transferer cleaner 17 is located to remove a residual toner on an intermediate transferer 50 after an image is transferred. Above the intermediate transferer 50, four image forming units 18 for yellow, cyan, magenta and black colors are located in line from left to right along a transport direction of the intermediate transferer 50 to form a tandem image forming developer 120. Above the tandem color image developer 120, an irradiator 21 is located. On the opposite side of the tandem color image developer 120 across the intermediate transferer 50, a second transferer 22 is located. The second transferer 22 includes a an endless second transfer belt 24 and two rollers 23 suspending the endless second transfer belt 24, and is pressed against the suspension roller 16 across the intermediate transferer 50 and transfers an image thereon onto a sheet. Beside the second transferer 22, a fixer 25 fixing a transferred image on the sheet is located. The fixer 25 includes an endless fixing belt 26 and a pressure roller 27 located pressing the fixing belt 26.

Below the second transferer 22 and the fixer 25, a sheet reverser 28 reversing the sheet to form an image on both sides thereof is located in the tandem color image forming apparatus 100.

Next, full-color image formation using a tandem image developer 120 will be explained. An original is set on a table 130 of the ADF 400 to make a copy, or on a contact glass 32 of the scanner 300 and pressed with the ADF 400.

When a start switch (not shown) is put on, a first scanner 33 and a second scanner 34 scans the original after the original set on the table 30 of the ADF 400 is fed onto the contact glass 32 of the scanner 300, or immediately when the original set thereon. The first scanner 33 emits light to the original and reflects reflected light therefrom to the second scanner 34. The second scanner further reflects the reflected light to a reading sensor 36 through an imaging lens 35 to read the color original (color image) as image information of black, yellow, magenta and cyan.

The black, yellow, magenta and cyan image information are transmitted to each image forming units 18, i.e., a black image forming unit, a yellow image forming unit, a magenta image forming unit and a cyan image forming unit in the tandem image developer 120 respectively, and the respective image forming units form a black toner image, a yellow toner image, a magenta toner image and a cyan toner image. Namely, each of the image forming units 18 in the tandem image developer 120 includes, as shown in FIG. 11, a photoreceptor 10, i.e., a photoreceptor for black 10K, a photoreceptor for yellow 10Y, a photoreceptor for magenta 10M and a photoreceptor for cyan 10C; a charger 60 uniformly charging the photoreceptor; an irradiator irradiating the photoreceptor with imagewise light (L in FIG. 11) based on each color image information to form an electrostatic latent image thereon; an image developer 61 developing the electrostatic latent image with each color toner, i.e., a black toner, a yellow toner, a magenta toner and a cyan toner to forma toner image thereon; a transfer charger 62 transferring the toner image onto an intermediate transferer 50; a photoreceptor cleaner 63; and a discharger 64. When a start switch (not shown) is put on, a drive motor (not shown) rotates one of the suspension rollers 14, 15 and 16 such that the other two rollers are driven to rotate, to rotate the intermediate transferer 50. At the same time, each of the image forming units 18 rotates a photoreceptor 10 and forms a single-colored image, i.e., a black image (K), a yellow image (Y), a magenta image (M) and cyan image (C) on each Photoreceptor 10K, 10Y, 10M and 0C. The single-colored images are sequentially transferred (first transfer) onto the intermediate transferer 50 to form a full-color image thereon.

On the other hand, when start switch (not shown) is put on, one of paper feeding rollers 142 of paper feeding table 200 is selectively rotated to take a sheet out of one of multiple-stage paper cassettes 144 in a paper bank 143. A separation roller 145 separates sheets one by one and feed the sheet into a paper feeding route 146, and a feeding roller 147 feeds the sheet into a paper feeding route 148 to be stopped against a resist roller 49. Alternatively, a paper feeding roller 150 is rotated to take a sheet out of a manual feeding tray 51, and a separation roller 52 separates sheets one by one and feed the sheet into a paper feeding route 53 to be stopped against the resist roller 49. The resist roller 49 is typically earthed, and may be biased to remove a paper dust from the sheet.

Then, in timing with a synthesized full-color image on the intermediate transferer 50, the resist roller 49 is rotated to feed the sheet between the intermediate transferer 50 and the second transferer 22, and the second transferer transfers (second transfer) the full-color image onto the sheet. The intermediate transferer 50 after transfer ring an image is cleaned by the intermediate transferer cleaner 17 to remove a residual toner thereon after the image is transferred.

The sheet the full-color image is transferred on is fed by the second transferer 22 to the fixer 25. The fixer 25 fixes the image thereon upon application of heat and pressure, and the sheet is discharged by a discharge roller 56 onto a catch tray 57 through a switch-over click 55. Alternatively, the switch-over click 55 feeds the sheet into the sheet reverser 28 reversing the sheet to a transfer position again to form an image on the backside of the sheet, and then the sheet is discharged by the discharge roller 56 onto the catch tray 57.

The image forming apparatus and the image forming method of the present invention including the toner of the present invention have good offset resistance and separability thereof, no problem of filming over photoreceptors thereof, and can produce high-definition images with quite little toner adherence to developer bearers and regulators even when used as a non-magnetic one-component developer.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

724 parts of an adduct of bisphenol A with 2 moles of ethyleneoxide, 276 parts isophthalic acid and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs, 32 parts of phthalic acid anhydride were added thereto and reacted for 2 hrs at 160° C. Next, the mixture was reacted with 188 parts of isophoronediisocyanate in ethyl acetate for 2 hrs at 80° C. to prepare a prepolymer including isocyanate (1). Next, 67 parts of the prepolymer (1) and 14 parts of isophoronediamine were mixed for 2 hrs at 50° C. to prepare a urea-modified polyester resin (1) having a weigh-average molecular weight of 64,000.

Similarly, in a reactor vessel including a cooling pipe, a stirrer and a nitrogen inlet pipe, 724 parts of an adduct of bisphenol A with 2 moles of ethyleneoxide and 276 parts of terephthalic acid were polycondensated for 8 hrs at a normal pressure and 230° C., and further, after the mixture was depressurized by 10 to 15 mm Hg and reacted for 5 hrs to prepare a unmodified polyester resin (a) having a peak molecular weight of 5,000. 200 parts of the urea-modified polyester (1) and 800 parts of the unmodified polyester resin (a) were dissolved and mixed in 2,000 parts of a mixed solvent formed of ethyl acetate and MEK (1/1) to prepare a toner binder (1) ethyl acetate/MEK solution. The toner binder (1) ethyl acetate/MEK solution was partially depressurized and dried to isolate the toner binder (1). The toner binder (1) had a glass transition temperature (Tg) of 62° C. and an acid value of 10.

371 parts of the toner binder (1), 54 parts of a carnauba wax having a melting point of 82° C., 54 parts of an ester wax having a melting point of 84° C., 22 parts of charge controlling agent (salicylic acid metal complex E-84 from Orient Chemical Industries, Ltd.) and 930 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 250 parts of Phthalocyanine Blue pigment and 500 parts of ethyl acetate were added to the mixture and mixed for 1 hr to prepare a material solution. 430 parts of the material solution were transferred into another vessel, and the pigment and wax therein were dispersed by a beads mill (Ultra Visco Mill from IMECS CO., LTD.) for 3 passes under the following conditions:

liquid feeding speed of 1 kg/hr
peripheral disc speed of 6 m/sec, and
filling zirconia beads having diameter 0.5 mm
for 80% by volume.

Next, 1,430 parts of an ethyl acetate solution of the toner binder (1) having a concentration of 65% were added to the material solution and the mixture was stirred by the beads mill for one pass under the same conditions to prepare a pigment and wax dispersion.

706 parts of ion-exchanged water, 294 parts of a slurry including 10% hydroxyapatite Supertite 10 from Nippon Chemical Industrial Co., Ltd. and 0.2 parts of sodium dodecylbenzenesulfonate were uniformly dissolved in a beaker. Then, while the mixture was stirred at 12,000 rpm by a TK-type homomixer at 60° C., the above-mentioned toner material solution was added thereto and the mixture was stirred for 10 min. Next, the mixture was moved into a flask with a stirrer and a thermometer, and heated at 98° C. to remove a solvent. Then, the mixture was filtered, washed, dried and classified by a wind force to prepare a parent toner having a volume-average particle diameter of 5 μm.

Finally, 100 parts of the parent toner, 0.5 parts of hydrophobic silica (surface-treated hexamethyldisilazane having a specific surface area of 200 $m^2/g$) and 0.5 parts of hydrophobized-rutile titanium oxide (surface-treated isobutylmethoxysilane having an average primary particle diameter of 0.02 μm) were mixed by HENSCHEL mixer to prepare a toner (1).

Example 2

The procedure for preparation of the toner (1) in Example 1 was repeated to prepare a toner (2) except for changing 54 parts of the carnauba wax having a melting point of 82° C. and 54 parts of the ester wax having a melting point of 84° C. into 81 parts of the carnauba wax and 27 parts of the ester wax.

Example 3

The procedure for preparation of the toner (1) in Example 1 was repeated to prepare a toner (3) except for changing 54 parts of the carnauba wax having a melting point of 82° C. into 81 parts thereof.

Example 4

The procedure for preparation of the toner (1) in Example 1 was repeated to prepare a toner (4) except for changing 54 parts of the ester wax having a melting point of 84° C. into 27 parts thereof.

Example 5

The procedure for preparation of the toner (1) in Example 1 was repeated to prepare a toner (5) except for changing 54 parts of the ester wax having a melting point of 84° C. into 54 parts of an ester wax having a melting point of 79° C.

Example 6

The procedure for preparation of the toner (1) in Example 1 was repeated to prepare a toner (6) except for changing 54 parts of the ester wax having a melting point of 84° C. into 27 parts of a polyethylene wax having a melting point of 85° C.

Example 7

The procedure for preparation of the toner (1) in Example 1 was repeated to prepare a toner (7) except for changing 54 parts of the ester wax having a melting point of 84° C. into 27 parts of a polyethylene wax having a melting point of 73° C.

Comparative Example 1

The procedure for preparation of the toner (1) in Example 1 was repeated to prepare a toner (8) except for changing 54 parts of the carnauba wax having a melting point of 82° C. and 54 parts of the ester wax having a melting point of 84° C. into 108 parts of the carnauba wax.

Comparative Example 2

The procedure for preparation of the toner (1) in Example 1 was repeated to prepare a toner (9) except for changing 54 parts of the carnauba wax having a melting point of 82° C. and 54 parts of the ester wax having a melting point of 84° C. into 27 parts of the carnauba wax.

Comparative Example 3

The procedure for preparation of the toner (1) in Example 1 was repeated to prepare a toner (10) except for changing 54 parts of the carnauba wax having a melting point of 82° C. and 54 parts of the ester wax having a melting point of 84° C. into 108 parts of the ester wax.

Comparative Example 4

The procedure for preparation of the toner (1) in Example 1 was repeated to prepare a toner (11) except for changing 54 parts of the carnauba wax having a melting point of 82° C. and 54 parts of the ester wax having a melting point of 84° C. into 27 parts of the ester wax.

Comparative Example 5

The procedure for preparation of the toner (1) in Example 1 was repeated to prepare a toner (12) except for changing 54 parts of the ester wax having a melting point of 84° C. into 54 parts of an ester wax having a melting point of 60° C.

The maximum tensile strength and ratios thereof of each toner were measured. The results are shown in Tables 1 and 2.

TABLE 1

| | Wax 1 | | | Wax 2 | | |
|---|---|---|---|---|---|---|
| | Wax | Melting point | % by weight | Wax | Melting point | % by weight |
| Example 1 | Carnauba wax | 82° C. | 4 | Ester wax | 84° C. | 4 |
| Example 2 | Carnauba wax | 82° C. | 6 | Ester wax | 84° C. | 2 |
| Example 3 | Carnauba wax | 82° C. | 6 | Ester wax | 84° C. | 4 |
| Example 4 | Carnauba wax | 82° C. | 4 | Ester wax | 84° C. | 2 |
| Example 5 | Carnauba wax | 82° C. | 4 | Ester wax | 79° C. | 2 |
| Example 6 | Carnauba wax | 82° C. | 4 | Polyethylene wax | 85° C. | 2 |
| Example 7 | Carnauba wax | 82° C. | 4 | Polyethylene wax | 73° C. | 2 |
| Comparative Example 1 | Carnauba wax | 82° C. | 8 | — | — | — |
| Comparative Example 2 | Carnauba wax | 82° C. | 2 | — | — | — |
| Comparative Example 3 | — | — | — | Ester wax | 84° C. | 8 |
| Comparative Example 4 | — | — | — | Ester wax | 84° C. | 2 |
| Comparative Example 5 | Carnauba wax | 82° C. | 4 | Ester wax | 60° C. | 4 |

TABLE 2

| | FT120 | FT140 | FT160 | FT120/FT160 | FT120/FT140 | FT140/FT160 | FP100 | FP200 | FP100/FP200 |
|---|---|---|---|---|---|---|---|---|---|
| Example 1 | 1.10 | 1.04 | 0.89 | 1.24 | 1.06 | 1.17 | 0.89 | 0.60 | 1.48 |
| Example 2 | 1.22 | 1.13 | 0.95 | 1.28 | 1.08 | 1.19 | 0.95 | 0.68 | 1.40 |
| Example 3 | 1.06 | 1.02 | 0.92 | 1.15 | 1.04 | 1.11 | 0.92 | 0.62 | 1.48 |
| Example 4 | 1.35 | 1.24 | 1.08 | 1.25 | 1.09 | 1.15 | 1.08 | 0.74 | 1.46 |
| Example 5 | 1.38 | 1.25 | 1.10 | 1.25 | 1.10 | 1.14 | 1.10 | 0.75 | 1.47 |
| Example 6 | 1.28 | 1.16 | 0.98 | 1.31 | 1.10 | 1.18 | 0.98 | 0.72 | 1.36 |
| Example 7 | 1.19 | 1.11 | 0.95 | 1.25 | 1.07 | 1.17 | 0.95 | 0.66 | 1.44 |
| Comparative Example 1 | 1.76 | 1.68 | 1.61 | 1.09 | 1.05 | 1.04 | 1.61 | 0.89 | 1.81 |
| Comparative Example 2 | 2.14 | 1.95 | 1.82 | 1.18 | 1.10 | 1.07 | 1.82 | 1.03 | 1.77 |
| Comparative Example 3 | 1.33 | 1.20 | 0.53 | 2.51 | 1.11 | 2.26 | 0.53 | 0.42 | 1.26 |
| Comparative Example 4 | 1.68 | 1.53 | 0.98 | 1.71 | 1.10 | 1.56 | 0.98 | 0.58 | 1.69 |
| Comparative Example 5 | 1.87 | 1.66 | 1.12 | 1.67 | 1.13 | 1.48 | 1.12 | 0.64 | 1.75 |

The cross section of each toner was observed by a TEM to find that the cross sections of the toners in Examples 1 to 7 showed sea and island structures wherein the islands had the shape of either a sphere, a spindle or a fiber.

The properties of each toner were evaluated by the following methods. The results are shown in Table 3.

Separability

An unfixed solid image (3 mm×36 mm) having a weight of 9 g/m$^2$ was produced by full-color printer LP-3000C from SEIKO EPSON CORPORATION on a cross-direction A4 paper having a weight of 45 g/m$^2$ vertically passing therein. The unfixed image was fixed at various temperatures by the fixer in FIG. 2 at 140 mm/sec to determine a range of separable/non-offset temperature.

○: not less than 50° C.

Δ: not less than 30° C. and less than 50° C.

×: less than 30° C.

Hot Offset Resistance

An unfixed halftone image was produced by full-color printer LP-3000C from SEIKO EPSON CORPORATION. The unfixed halftone image was fixed by the fixer in FIG. 2 at a fixing temperature of from 140 to 190° C. at 5° C. intervals to find a temperature at which the hot offset occurs.

○: not less than 160° C.

Δ: not less than 155° C. and less than 160° C.

×: less than 155° C.

Toner Adherence

Predetermined images having an image ratio of 6% were continuously produced by full-color printer LP-3000C from SEIKO EPSON CORPORATION in an environment of 23° C. and 45% RH. After 2,000 images were produced, the thin layer of the toner on the developing roller and the images were visually observed.

○: No stripes and no irregularities on the roller

Δ: Some stripes or irregularities, but no stripes on the images

×: Many stripes or irregularities, and problems of noise, toner adherence and toner spill Filming Over Photoreceptor Predetermined images having an image ratio of 6% were continuously produced by full-color printer LP-3000C from SEIKO EPSON CORPORATION in an environment of 23° C. and 45% RH. After 2,000 images were produced, the photoreceptor and the intermediate transferer were visually observed.

○:No toner filming and no black spot on the photoreceptor and the intermediate transferer Δ: Some toner filming and black spots on the photoreceptor or the intermediate transferer, but no influence thereof on the images ×: Toner filming and black spots on both of the photoreceptor and the intermediate transferer, or on either thereof, and the images had influences thereof Thermostable Preservability After the toner was stored at 50° C. for 8 hrs, the toner was sieved with a sieve having 42 meshes for 2 min. The residual ratio of the toner on the sieve was an index of the thermostable preservability.

◎: less than 10%

○: not less than 10% and less than 20%

Δ: not less than 20% and less than 30%

×: not less than 30%

TABLE 3

| | Toner | Separability | Hot offset | Toner adherence | Filming | Thermostable preservability |
|---|---|---|---|---|---|---|
| Example 1 | Toner (1) | ○ | ○ | ○ | ○ | ○ |
| Example 2 | Toner (2) | ○ | ○ | ○ | ○ | ○ |
| Example 3 | Toner (3) | ○ | ○ | ○ | ○ | ○ |
| Example 4 | Toner (4) | ○ | ○ | ○ | ○ | ○ |
| Example 5 | Toner (5) | ○ | ○ | ○ | ○ | ○ |
| Example 6 | Toner (6) | ○ | ○ | ○ | ○ | ○ |
| Example 7 | Toner (7) | ○ | ○ | ○ | ○ | ○ |
| Comparative Example 1 | Toner (8) | X | ○ | ○ | ○ | ○ |
| Comparative Example 2 | Toner (9) | X | X | ○ | ○ | ○ |
| Comparative Example 3 | Toner (10) | ○ | X | X | X | X |
| Comparative Example 4 | Toner (11) | X | X | ○ | ○ | ○ |
| Comparative Example 5 | Toner (12) | X | X | X | X | X |

This application claims priority and contains subject matter related to Japanese Patent Application No. 2005-078515 and 2006-034303, filed on Mar. 18, 2005 and Feb. 10, 2006 respectively, the entire contents of each of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

a binder resin;

a colorant; and a release agent in an amount from 1 to 10 parts by weight per 100 parts by weight of the binder resin, wherein the release agent has a melting point of from 60 to 100° C. and includes at least one wax selected from the group consisting of a fatty acid ester, a low-molecular-weight polyethylene, and a carnauba wax, wherein the toner satisfies the following relationships (1) and (2):

$$1.0 \leqq FT120/FT160 \leqq 1.5 \quad (1)$$

wherein FT120 is a maximum tensile strength (N) of 1.5 or less, measured when 10 g/m$^2$ of an unfixed toner on an aluminum plate comprising a surface coated with TEFLON PFA is vertically separated from the surface of said aluminum plate at a constant speed after being pressed thereon at a pressure of 100 kPa, wherein said aluminum plate has a width of 50 mm, a depth of 60 mm, a thickness of 2 mm and a temperature of 120° C., and FT160 is a maximum tensile strength (N), measured when 10 g/m$^2$ of the unfixed toner on an aluminum plate comprising a surface coated with TEFLON PFA is vertically separated from the surface of said aluminum plate at a constant speed after being pressed thereon at a pressure of 100 kPa, wherein said aluminum plate has a width of 50 mm, a depth of 60 mm, a thickness of 2 mm and a temperature of 160° C.;

$$1.0 \leqq FP100/FP200 \leqq 1.5 \quad (2)$$

wherein FP100=FT160, and FP200 is a maximum tensile strength (N) measured when 10 g/m$^2$ of the unfixed toner on an aluminum plate comprising a surface coated with TEFLON PFA is vertically separated from the surface of said aluminum plate at a constant speed after being pressed thereon at a pressure of 200 kPa, wherein said aluminum plate has a width of 50 mm, a depth of 60 mm, a thickness of 2 mm and a temperature of 160° C.

2. The toner of claim 1, wherein the toner satisfies the following relationships (1-1) and (1-2):

$$1.0 \leqq FT120/FT140 \leqq 1.3 \quad (1\text{-}1)$$

wherein FT140 is a maximum tensile strength (N) measured when 10 g/m$^2$ of unfixed toner on an aluminum plate comprising a surface coated with TEFLON PFA is vertically separated from the surface of said aluminum plate at a constant speed after being pressed thereon at a pressure of 100 kPa, wherein said aluminum plate has a width of 50 mm, a depth of 60 mm, a thickness of 2 mm and a temperature of 140° C.;

$$1.0 \leqq FT140/FT160 \leqq 1.3 \quad (1\text{-}2).$$

3. The toner of claim 1, wherein FT120 is a maximum tensile strength (N) having a value from 0.1 to 1.4.

4. The toner of claim 1, wherein the toner has a sea and an island structure in a cross section thereof when imaged with a transmittance electron microscope (TEM), and wherein the island structure has the shape of a sphere, a spindle or a fiber.

5. The toner of claim 1, wherein the toner comprises at least two release agents wherein one release agent is a carnauba wax.

6. The toner of claim 1, wherein the toner is granulated by a method comprising:

emulsifying or dispersing a solution or a dispersion of the binder resin, the colorant, and the release agent in an aqueous medium.

7. The toner of claim 6, wherein the solution or the dispersion of the binder resin, the colorant, and the release agent further comprises an organic solvent, and wherein the organic solvent is removed from the toner after granulation.

8. The toner of claim 6, wherein the toner further comprises a polymer and a compound comprising a group having an active hydrogen wherein the polymer and the compound react to form an adhesive base material in the toner.

9. The toner of claim 1, wherein the toner comprises a polyester resin having a glass transition temperature not less than 40° C.

10. A developer comprising the toner according to claim 1.

11. A toner container comprising the toner according to claim 1.

12. A process cartridge, comprising at least:

an electrostatic latent image bearer; and an image developer configured to develop an electrostatic latent image with the toner according to claim 1 to form a toner image on the electrostatic latent image bearer.

13. A image forming apparatus, comprising:

an electrostatic latent image bearer;

a charge configured to charge the electrostatic latent image bearer;

an irradiator configured to irradiate the electrostatic latent image bearer to form an electrostatic latent image thereon;

an image developer configured to develop the electrostatic latent image with the toner according to claim 1 to form a toner image thereon;

a transferer configured to transfer the toner image onto a recording medium; and a fixer configured to fix the toner image on the recording medium.

14. The image forming apparatus of claim 13, wherein the fixer is an endless belt, a roller or a combination thereof.

15. The image forming apparatus of claim 13, wherein the fixer is an oilless fixer without application of an oil.

16. An image forming method, comprising:

charging an electrostatic latent image bearer;

irradiating the electrostatic latent image bearer to form an electrostatic latent image thereon;

developing the electrostatic latent image with the toner according to claim 1 to form a toner image thereon;

transferring the toner image onto a recording medium; and fixing the toner image on the recording medium.

17. The toner of claim 8, wherein the adhesive base material comprises a urea-modified polyester resin.

18. The toner of claim 1, wherein the toner comprises a polyester resin having a hydroxyl value of from 5 KOH mg/g to 120 KOH mg/g.

19. The toner of claim 1, wherein the toner comprises a polyester resin having a hydroxyl value of from 20 KOH mg/g to 80 KOH mg/g.

20. The toner of claim 1, wherein the toner comprises a polyester resin having an acid value of from 1.0 KOH mg/g to 50.0 KOH mg/g.

21. The toner of claim 1, wherein the toner comprises a polyester resin having an acid value of from 1.0 KOH mg/g to 30.0 KOH mg/g.

22. The toner of claim 9, wherein the polyester resin is from 50% to 100% by weight.

23. A toner, comprising:

a binder resin;

a colorant; and a release agent in an amount from 1 to 10 parts by weight per 100 parts by weight of the binder resin, wherein the release agent is a wax having a softening point from 60 to 100° C. selected from the group consisting of a fatty acid ester, a low molecular weight polyethylene, camauba wax, and mixtures thereof, wherein the toner satisfies the following relationships (1) and (2):

$$1.0 \leqq FT120/FT160 \leqq 1.5 \quad (1)$$

wherein FT120 is a maximum tensile strength (N) of 1.5 or less, measured when 10 g/m$^2$ of an unfixed toner on an aluminum plate comprising a surface coated with TEFLON PFA is vertically separated from the surface of said aluminum plate at a constant speed after being pressed thereon at a pressure of 100 kPa, wherein said aluminum plate has a width of 50 mm, a depth of 60 mm, a thickness of 2 mm and a temperature of 120° C., and FT160 is a maximum tensile strength (N), measured when 10 g/m$^2$ of the unfixed toner on an aluminum plate comprising a surface coated with TEFLON PFA is vertically separated from the surface of said aluminum plate at a constant speed after being pressed thereon at a pressure of 100 kPa, wherein said aluminum plate has a width of 50 mm, a depth of 60 mm, a thickness of 2 mm and a temperature of 160° C.;

$$1.0 \leqq FP100/FP200 \leqq 1.5 \quad (2)$$

wherein FP100=FT160, and FP200 is a maximum tensile strength (N) measured when 10 g/m$^2$ of the unfixed toner on an aluminum plate comprising a surface coated with TEFLON PFA is vertically separated from the surface of said aluminum plate at a constant speed after being pressed thereon at a pressure of 200 kPa, wherein said aluminum plate has a width of 50 mm, a depth of 60 mm, a thickness of 2 mm and a temperature of 160° C.

24. The toner of claim 23, wherein FT120 is a maximum tensile strength (N) having a value from 0.1 to 1.4.

25. A developer comprising the toner according to claim 23.

* * * * *